US007475584B2

(12) United States Patent
Naito et al.

(10) Patent No.: US 7,475,584 B2
(45) Date of Patent: Jan. 13, 2009

(54) SERVO-DRIVE SYSTEM AND CONTINUOUS FINISHING SYSTEM OF PRESS

(75) Inventors: Kinshiro Naito, Kanagawa (JP); Tokuzo Sekiyama, Gunma (JP); Toshiaki Otake, Kanagawa (JP); Haruhiko Kuriyama, Kanagawa (JP)

(73) Assignee: Amada Company, Limited, Kanagawa (JP)

( * ) Notice: Subject to any disclaimer, the term of this patent is extended or adjusted under 35 U.S.C. 154(b) by 563 days.

(21) Appl. No.: 10/517,317

(22) PCT Filed: Jun. 17, 2003

(86) PCT No.: PCT/JP03/07675

§ 371 (c)(1),
(2), (4) Date: Aug. 3, 2005

(87) PCT Pub. No.: WO03/106154

PCT Pub. Date: Dec. 24, 2003

(65) Prior Publication Data

US 2006/0055269 A1 Mar. 16, 2006

(30) Foreign Application Priority Data

| | | |
|---|---|---|
| Jun. 18, 2002 | (JP) | 2002-177143 |
| Jun. 18, 2002 | (JP) | 2002-177145 |
| Jun. 18, 2002 | (JP) | 2002-177149 |
| Jun. 18, 2002 | (JP) | 2002-177150 |
| May 22, 2003 | (JP) | 2003-145372 |
| May 22, 2003 | (JP) | 2003-145374 |
| May 22, 2003 | (JP) | 2003-145377 |

(51) Int. Cl.
*B30B 15/14* (2006.01)
*B21D 9/08* (2006.01)
*B21J 9/18* (2006.01)

(52) U.S. Cl. ..... 72/443; 72/449; 72/450; 72/452.5; 83/548; 83/628; 83/629; 74/25; 74/49; 74/424.5; 74/490.1; 74/490.07; 74/665 B; 100/48; 100/98 R; 100/273; 100/280; 100/282; 100/292

(58) Field of Classification Search ..... 72/443, 72/449, 450, 452.5; 83/548, 628, 629; 74/25, 74/49, 424.5, 490.1, 490.07, 665 B; 100/48, 100/98 R, 273, 280, 281, 282, 283, 292, 293
See application file for complete search history.

(56) References Cited

U.S. PATENT DOCUMENTS 2,771,790 A * 11/1956 Munschauer ..... 74/665 B (Continued)

FOREIGN PATENT DOCUMENTS

DE 19548439 7/1996

(Continued)

OTHER PUBLICATIONS

English language Abstract of JP 2000-358382.

(Continued)

*Primary Examiner*—David B Jones
(74) *Attorney, Agent, or Firm*—Greenblum & Bernstein, P.L.C.

(57) ABSTRACT

A servo drive system of a press machine has a pair of servo motors which can generate necessary ram pressure by compositing and using a torque based on the same speed-torque characteristics. The servo motors are symmetric with each other in a mirror image manner. The servo motors are opposed to each other at opposite ends of an operation shaft which vertically moves a ram. The servo motors are integrally operated, thereby directly driving the operation shaft.

17 Claims, 16 Drawing Sheets

U.S. PATENT DOCUMENTS

| | | | | | |
|---|---|---|---|---|---|
| 5,012,661 | A | | 5/1991 | Catti et al. | |
| 5,299,443 | A | * | 4/1994 | Nakamura | 72/446 |
| 5,468,194 | A | * | 11/1995 | Hayashi | 477/3 |
| 5,669,257 | A | | 9/1997 | Inoue et al. | |
| 5,832,816 | A | | 11/1998 | Seto et al. | |
| 5,952,755 | A | | 9/1999 | Lubas | |
| 5,953,972 | A | | 9/1999 | Nakagawa | |
| 7,102,316 | B2 | * | 9/2006 | Beyer et al. | 100/178 |
| 7,234,337 | B2 | * | 6/2007 | Nagae | 72/449 |

FOREIGN PATENT DOCUMENTS

| | | | | |
|---|---|---|---|---|
| DE | 19810406 | A1 | * | 9/1999 |
| EP | 0827790 | | | 3/1998 |
| EP | 0866540 | | | 9/1998 |
| EP | 0941832 | | * | 9/1999 |
| JP | 54-105716 | | | 8/1979 |
| JP | 8-47279 | | | 2/1996 |
| JP | 8-108229 | | | 4/1996 |
| JP | 8-215896 | | | 8/1996 |
| JP | 10-327548 | | | 12/1998 |
| JP | 10-328891 | | | 12/1998 |
| JP | 10328891 | | * | 12/1998 |
| JP | 2000-176698 | | | 6/2000 |
| JP | 2000-288792 | | | 10/2000 |
| JP | 2000-358382 | | | 12/2000 |
| JP | 2001-62591 | | | 3/2001 |
| JP | 2001-062596 | | | 3/2001 |
| JP | 2001-276467 | | | 10/2001 |
| JP | 2002-210600 | | | 7/2002 |

OTHER PUBLICATIONS

English language Abstract of JP 10-328891.
English language Abstract of JP 2000-176698.
English language Abstract of JP 8-47279.
English language Abstract of DE 19548439.
English Language Abstract of JP 2001-062596.
English Language Abstract of JP2000-288792.
English Language Abstract of JP08-215896.
English Language Abstract of JP2001-062591.
English Language Abstract of JP08-108229.
English Language Abstract of JP54-105716.
English Language Abstract of JP2001-276467.
English Language Abstract of JP 2002-210600.

* cited by examiner

SERVO-DRIVE SYSTEM AND CONTINUOUS FINISHING SYSTEM OF PRESS

TECHNICAL FIELD

The present invention relates to a servo drive system of a press machine applied to a turret punch press, and more particularly, to a continuous working system of a press machine applied to a turret punch press.

BACKGROUND ART

Conventionally, there are electric punch presses using a servo motor as a driving source of a ram. In punching working of a press machine such as a punch press, since extremely large noise is generated during the working, it is required to decrease this kind of noise as small as possible.

Principles of generation of noise in the punching working are complicated, and reasons of generation of noise are varied depending upon various conditions such as the material of the work, the plate thickness, and the like. However, it is known that the noise is large when the punching speed by driving of a ram is fast, the noise becomes smaller when the punching speed becomes slower, and when the punching speed is constant, the noise is small when the load is light, and as the load becomes heavier, the noise becomes larger.

The above conventional technique is disclosed in Japanese Patent Applications Laid-Open Nos. 2001-62591 and 2001-62596.

However, the conventional electric punch press generates a torque necessary for working by using a mechanism such as a toggle and a flywheel. Therefore, the inertia caused by this mechanism delays the reciprocating motion of the ram. In addition, an operation shaft which vertically moves the ram and a main shaft of a servo motor is driven through a power transmission mechanism such as a gear, and a loss or a delay is generated by the power transmission mechanism. Even if the speed of the servo motor is controlled, the driving speed of the ram can not follow the speed of the servo motor easily, and therefore the conventional technique is not suitable for controlling the speed of the ram.

For this reason, the conventional technique has problems that since the punching speed is set substantially at a constant value irrespective of the weight of the load, if the punching speed is set lower to decrease the noise, the operation efficiency is largely deteriorated, and if the punching speed is set higher to enhance the operation efficiency, a large noise is generated and thus, reduction of noise and enhancement of operation efficiency can not be satisfied at the same time.

According to the conventional system, a predetermined punching pattern is switched in a hydraulic press system depending upon the plate thickness, material, and the like to satisfy both the noise reduction and increase of punching speed. Therefore, complicated control systems such as high-speed processing hardware and software are required.

Generally, there are a hydraulic punch press using hydraulic pressure as the driving source of the ram and an electric punch press using a servo motor. In the punch press, the same punching die such as a nibble is used and a work is continuously punched in some cases. In such a continuous punching working, a speedup of the ram is required.

In the conventional hydraulic punch press, however, since the ram is reciprocated using a hydraulic pressure and a switching valve, response speed is inferior to that of the electric control, and a response delay to the control command is generated and thus, the conventional hydraulic punch press is not suitable for speedup of the ram.

Further, the conventional technique has problems that since the punching speed is set substantially at a constant value irrespective of the weight of the load, if the punching speed is set lower to decrease the noise, the operation efficiency is largely deteriorated, and if the punching speed is set higher to enhance the operation efficiency, a large noise is generated and thus, reduction of noise and enhancement of operation efficiency can not be satisfied at the same time.

It is assumed herein to drive the operation shaft which vertically moves the ram, directly by the servo motor without through a power transmission mechanism such as a gear and without using a mechanism such as a toggle and a flywheel. If the operation shaft is driven directly by the servo motor, there is a possibility that the punching speed can automatically be increased or decreased according to the load, and with this, there is a possibility that both the noise reduction and the enhancement of operation efficiency can be satisfied at the same time.

If a case where a mechanism such as a toggle and a flywheel is used for generating a torque necessary for the working and a case where the mechanism is not used (direct driving by the servo motor) are compared with each other, in the punching working using the punch press, since a large punching energy is required at the time of the punching working in addition to the kinetic energy for vertically moving the ram at high speed, a servo motor having a greater rating is required in the direct driving.

In order to drive the operation shaft which vertically moves the ram directly by the servo motor, it is necessary to supply, to the servo motor, electric energy for high speed operation and for punching working, and a peak electricity of a control circuit for the servo motor becomes extremely high.

The present invention has been achieved in order to solve the conventional problems, and it is a first object of the present invention to eliminate the conventional problems, and to provide a servo drive system of a press machine which can decrease a noise by automatically increasing and decreasing the punching speed according to a load without using a mechanism such as a toggle and a flywheel, and without using a power transmission mechanism such as a gear, and which can prevent mechanical portions corresponding to one side of the operation shaft from being distorted, and realize stabilized operation.

It is a second object of the present invention to eliminate the conventional problems, and to provide a servo drive system of a press machine which can decrease a noise and enhance the operation efficiency at the same time by automatically increasing and decreasing the punching speed according to a load.

It is a third object of the present invention to eliminate the conventional problems, and to provide a continuous working system of a press machine in which transmission of a driving force is not delayed in principle, control delay is not generated, responding speed is high, and operation speed is high, while using a servo motor as a driving source of a ram without using a mechanism such as a toggle and a flywheel and a power transmission mechanism such as a gear.

It is a fourth object of the present invention to eliminate the conventional problems, and to provide a servo drive system of a punch press which can decrease a noise and enhance the operation efficiency at the same time by automatically increasing and decreasing the punching speed according to a load, and reduce a peak electricity of a control circuit for the servo motor.

DISCLOSURE OF THE INVENTION

To achieve the first object, a first aspect of the present invention provides a servo drive system of a press machine including: a ram; an operation shaft which vertically moves the ram; and a pair of servo motors which operate as power sources of the ram and which composite and use torques based on the same speed-torque characteristics, thereby generating necessary ram pressure, wherein the pair of servo motors are formed symmetrically with each other in a mirror image manner, the pair of servo motors are opposed to each other at opposite ends of the operation shaft, and the pair of servo motors are operated integrally so that the pair of servo motors directly drive the operation shaft to vertically move the ram.

A second aspect of the present invention provides the servo drive system according to the first aspect, wherein a power unit of a servo amplifier of one of the pair of servo motors and a power unit of a servo amplifier of the other of the pair of servo motor are driven by the same gate signal, thereby integrally operating both the servo motors.

A third aspect of the present invention provides the servo drive system according to the first or the second aspect, wherein the pair of servo motors use a torque based on speed-torque characteristics of a motor, and if a load is received from a work during a lowering operation of the ram to generate necessary ram pressure without utilizing inertia of a mechanism, speeds of both the servo motors are reduced according to the load, thereby reducing the lowering speed of the ram.

A fourth aspect of the present invention provides the servo drive system according to any one of the first to the third aspects, wherein the operation shaft which vertically moves the ram comprises an eccentric shaft, and the eccentric shaft of the servo motor is formed as a motor main shaft.

A fifth aspect of the present invention provides the servo drive system according to any one of the first to the fourth aspects, wherein sleeves each provided at its outer periphery with an even number of magnetic pole magnets along a circumferential direction thereof at predetermined distances from one another are fitted over peripheries of left and right end extensions of the eccentric shaft, thereby forming rotors of the pair of servo motors, magnetic pole positions (positions of the magnetic pole magnets in the circumferential direction) of the left and right sleeves are positioned such that the sleeves are symmetric with each other in a mirror image manner and the sleeves are fixed by bushes, stators of the pair of servo motors have outer cylinders around which three-phase armature windings are wound, and the outer cylinders are respectively fitted over the rotors, and the left and right outer cylinders are positioned such that positions of the three-phase armature windings of the outer cylinders in the circumferential direction are symmetric with each other in a mirror image manner, and the outer cylinders are fixed to left and right supporting frames of the eccentric shaft.

According to the servo drive system of the first to the fifth aspects, since the operation shaft is directly driven by using the pair of servo motors which can generate necessary ram pressure, a mechanism such as a toggle and a flywheel as well as a power transmission mechanism such as a gear are not used and thus, the punching speed can automatically be increased or reduced according to the load.

Further, a noise can be reduced, a distortion is prevented from being generated in various portions of the machine corresponding to one side of the operation shaft, and stable operation can be realized.

To achieve the second object, a sixth aspect of the present invention provides a servo drive system of a press machine which uses a servo motor as a driving source of a ram, wherein the servo motor uses a torque based on speed-torque characteristics of a motor, necessary ram pressure can be generated without utilizing inertia of a mechanism, the system employs the servo motor in which if a load is received from a work during a lowering operation of the ram, motor speed is reduced according to the load, thereby reducing the lowering speed of the ram, and the servo motor directly drives an operation shaft which vertically moves the ram.

A seventh aspect of the present invention provides a servo drive system of a press machine which uses a pair of servo motors as driving sources of a ram, wherein the pair of servo motors are opposed to each other at opposite ends of an operation shaft which vertically moves a ram, the servo motors composite and use torques based on the same speed-torque characteristics, the system employs the pair of servo motors in which if a load is received from a work during a lowering operation of the ram, motor speed is reduced according to the load, thereby reducing the lowering speed of the ram, and the pair of servo motors are integrally operated, thereby directly driving the operation shaft.

An eighth aspect of the present invention provides the servo drive system according to the sixth or the seventh aspect, wherein the operation shaft which vertically moves the ram comprises an eccentric shaft, and the eccentric shaft of the servo motor is formed as a motor main shaft.

According to the servo drive system of the sixth to the eighth aspects, the system employs the servo motor in which if a load is received from a work during a lowering operation of the ram, the lowering speed of the ram is reduced, and the operation shaft which vertically moves the ram is directly driven. Therefore, the punching speed can automatically be increased or reduced according to the load. With this, the noise can be reduced and the operation efficiency can be enhanced at the same time.

To achieve the third object, a ninth aspect of the present invention provides a continuous working system of a press machine which uses a servo motor as a power source of a ram, wherein an operation shaft which vertically moves the ram is directly driven by using a servo motor which can generate necessary ram pressure by using a torque based on speed-torque characteristics of a motor, and the operation shaft is continuously reciprocated and turned through an angle range corresponding to a distance between a predetermined lower end position required for press working and a position where the ram is returned from the lower end position and a lower end of the ram is separated from a tool upper surface such that the ram vertically moves between these positions by the servo motor, thereby subjecting a work to a continuous press working.

A tenth aspect of the present invention provides a continuous working system of a press machine which uses a pair of servo motors as power sources of a ram, wherein the pair of servo motors are disposed opposed to each other at opposite ends of an operation shaft which vertically moves the ram, the servo motors composite and use a torque based on the same speed-torque characteristics so that the servo motors can generate necessary ram pressure and the operation shaft which vertically moves the ram is directly driven by using the servo motors, and the operation shaft is continuously reciprocated and turned through an angle range corresponding to a distance between a predetermined lower end position required for press working by the ram and a position where the ram is returned from the lower end position and a lower end of the ram is separated from a tool upper surface such that the ram vertically moves between these positions by the pair of servo motors, thereby subjecting a work to a continuous press working.

An eleventh aspect of the present invention provides the continuous working system of the press machine according to the ninth or the tenth aspect, wherein the servo motor uses a torque based on the speed-torque characteristics of the motor, and the servo motor can generate necessary ram pressure without utilizing inertia of a mechanism.

A twelfth aspect of the present invention provides the continuous working system of the press machine according to the ninth or the tenth aspect, wherein the operation shaft which vertically moves the ram comprises an eccentric shaft, and the eccentric shaft of the servo motor is formed as a motor main shaft.

According to the continuous working system of the ninth to the twelfth aspects, the operation shaft is reciprocated and turned continuously through the angle range corresponding to the distance between both the positions of the ram by the servo motor, thereby subjecting the work to the continuous press working. Therefore, the operation shaft which vertically moves the ram can be directly driven by the servo motor without using a mechanism such as a toggle and a flywheel or a power transmission mechanism such as a gear. Therefore, transmission of a driving force is not delayed in principle, control delay is not generated, responding speed is high, and operation speed is high.

To achieve the fourth object, a thirteenth aspect of the present invention provides a servo drive system of a punch press which uses a servo motor as a power source of a ram, wherein an operation shaft which vertically moves the ram is directly driven by using the servo motor which can generate necessary ram pressure by using a torque based on speed-torque characteristics of a motor, and the servo motor has a control power driver, the power driver being provided at its front stage with a reactor which suppresses peak current by cutting off high frequency current component, and a capacitor which supplies electric energy which becomes short due to suppression of the peak current.

A fourteenth aspect of the present invention provides the servo drive system of the press machine according to the thirteenth aspect, wherein the capacitor supplies high speed operation electric energy and/or punching out electric energy which become short due to suppression of the peak current.

According to the servo drive system of the thirteenth and the fourteenth aspects, the servo motor has the control power driver, the power driver being provided at its front stage with the reactor which suppresses peak current by cutting off high frequency current component, and the capacitor which supplies electric energy which becomes short due to suppression of the peak current. Therefore, it is possible to decrease a noise and to enhance the operation efficiency at the same time by automatically increasing and decreasing the punching speed according to a load, and it is possible to reduce a peak electricity of a control circuit for the servo motor.

THE BEST MODE FOR CARRYING OUT THE INVENTION

Embodiments of the present invention will be explained in detail with reference to the accompanying drawings.

Figure 1:
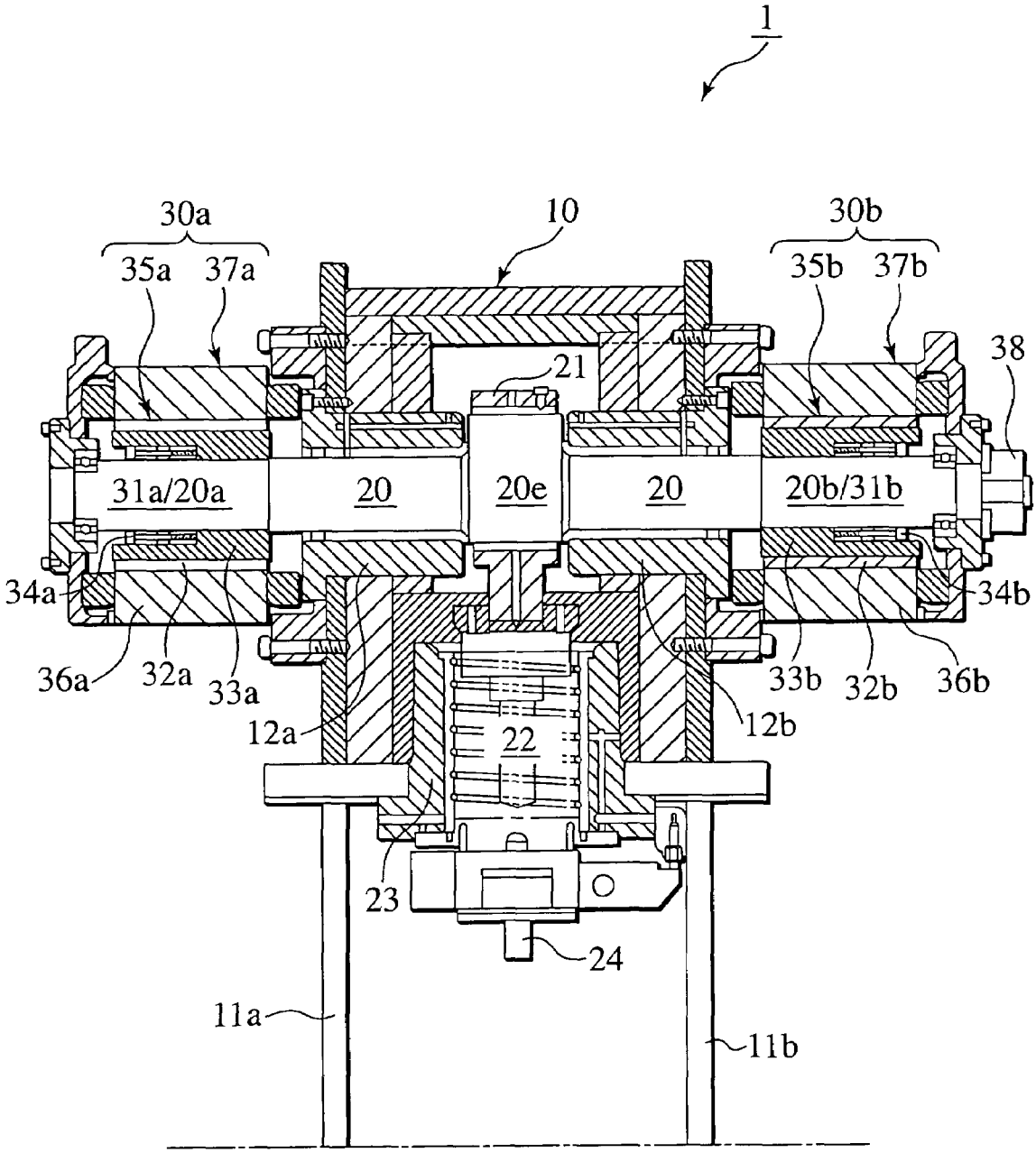
FIG. 1 is a vertical sectional view of an essential portion showing an embodiment of a servo drive system (continuous working system) of a press machine according to the present invention.
Figure 2:
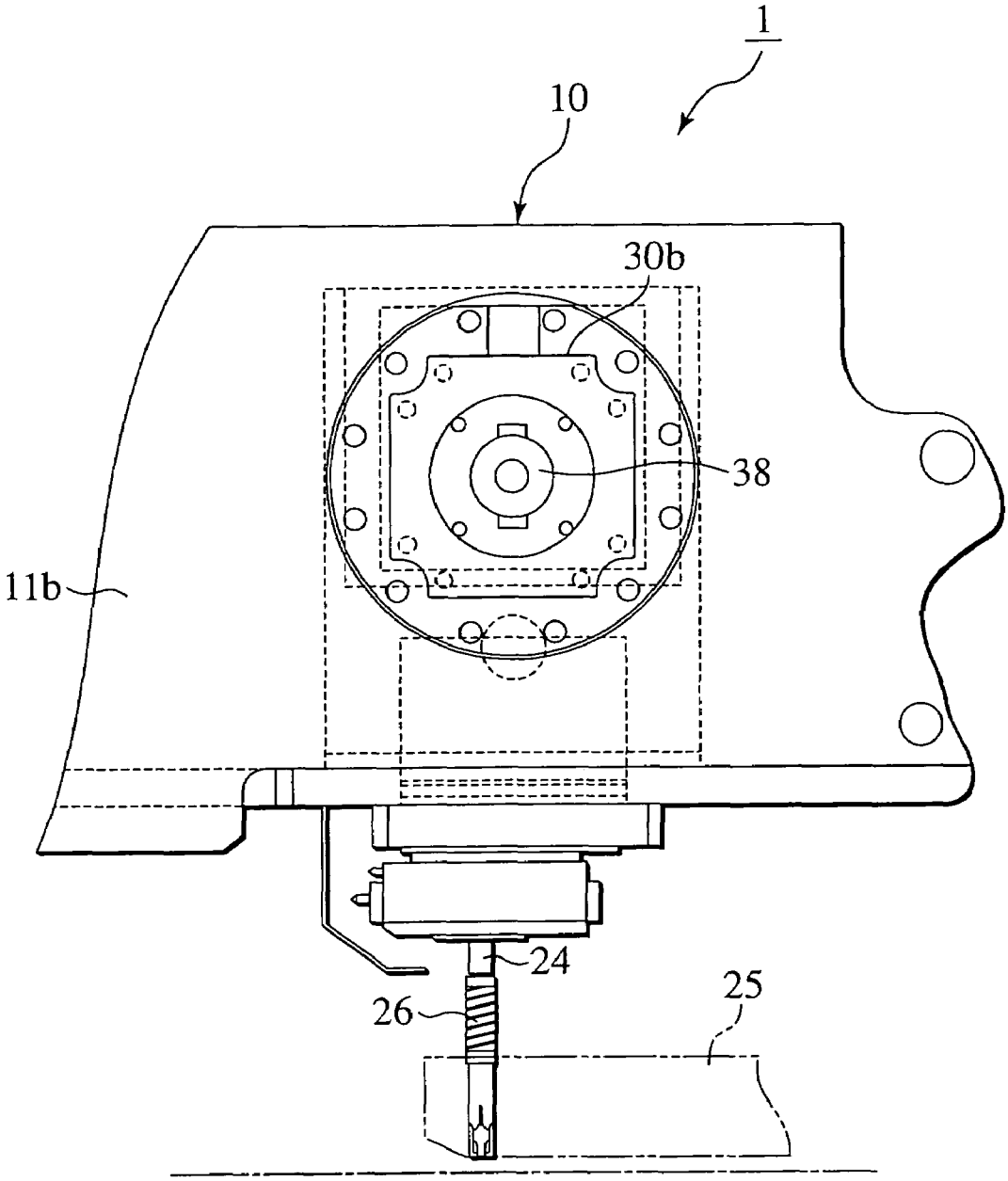
FIG. 2 is a right side view of an essential portion shown in FIG. 1.

FIG. 1 is a vertical sectional view of an essential portion showing an embodiment of a servo drive system (continuous working system) of a press machine according to the present invention, and FIG. 2 is a right side view thereof. The servo drive system (continuous working system) 1 of the press machine is applied to a turret punch press 10.

The turret punch press 10 has an eccentric shaft 20 which is pivotally supported by bearings 12*a* and 12*b* provided on frames 11*a* and 11*b* which stand in parallel to each other. The eccentric shaft 20 has an eccentric shaft portion 20*e* located substantially at a central portion between the frames 11*a* and 11*b*. A ram 22 is mounted on the eccentric shaft portion 20*e* through a connecting rod 21. If the eccentric shaft 20 rotates or turns, the ram 22 is vertically moved through the connecting rod 21 along a ram guide 23, and a striker 24 mounted on a lower end of the ram 22 is also vertically moved in unison with the ram 22. When the ram 22 moves downward, the striker 24 pushes a punching die 26 mounted on a turret 25 to punch a work out.

The eccentric shaft 20 is provided at its opposite ends with extensions 20*a* and 20*b* which extend outward from the frames 11*a* and 11*b*. Servo motors 30*a* and 30*b* using the extensions 20*a* and 20*b* as motor main shafts 31*a* and 31*b* are respectively mounted on outer sides of the frames 11*a* and 11*b*.

In the servo motor 30*a*, the extension 20*a* of the eccentric shaft 20 is constituted as the motor main shaft 31*a*. That is, a sleeve 33*a* is provided at its outer periphery with an even number (four) of magnetic pole magnets (permanent magnets) 32*a* in a circumferential direction at predetermined distances (90°) from one another. The sleeve 33*a* is fitted around and fixed to a periphery of the extension 20*a* of the eccentric shaft 20 through a bush 34*a*, thereby constituting a rotor 35*a*. The extension 20*a* of the eccentric shaft 20 serves as a center axis of the rotor 35*a*. The extension 20*a* is the motor main shaft 31*a* itself. Therefore, the servo motor 30*a* uses the extension 20*a*, i.e., the eccentric shaft 20 substantially as the rotor 35*a*.

In the servo motor 30*a*, an outer cylinder 36*a* around which three-phase armature windings Ua, Va, and Wa are wound is fitted over the rotor 35*a* and fixed to the frame 11*a*, thereby constituting a stator 37*a*.

On the other hand, in the servo motor 30*b*, like the servo motor 30*a*, the extension 20*b* of the eccentric shaft 20 is constituted as the motor main shaft 31*b*. That is, a sleeve 33*b* is provided at its outer periphery with an even number (four) of magnetic pole magnets (permanent magnets) 32*b* in a circumferential direction at predetermined distances (90°) from one another. The sleeve 33*b* is fitted around and fixed to a periphery of the extension 20*b* of the eccentric shaft 20 through a bush 34*b*, thereby constituting a rotor 35*b*. The extension 20*b* of the eccentric shaft 20 serves as a center axis of the rotor 35*b*. The extension 20*b* is the motor main shaft 31*b* itself. Therefore, the servo motor 30*b* uses the extension 20*b*, i.e., the eccentric shaft 20 substantially as the rotor 35*b*.

In the servo motor 30*b*, an outer cylinder 36*b* around which three-phase armature windings Ub, Vb, and Wb are wound is fitted over the rotor 35*b* and fixed to the frame 11*b*, thereby constituting a stator 37*b*.

The servo motor 30*a* and the servo motor 30*b* are the same, but they are symmetric with each other in a mirror image manner. Except this point, the servo motors 30*a* and 30*b* are completely the same, and they are integrally provided with the rotors 35*a* and 35*b*. Therefore, a rotary encoder 38 which detects rotation angles of the rotors 35*a* and 35*b* is provided on one of the servo motors (e.g., 30*b*) and the rotary encoder 38 is commonly used. The servo motors 30*a* and 30*b* have the same speed-torque characteristics, and a torque based on the speed-torque characteristics is synthesized and used. With this, the servo motors 30*a* and 30*b* have a function of generating necessary ram pressure.

That is, the magnetic pole of the rotor 35*a* of the servo motor 30*a* (position of the magnetic pole in the circumferential direction of the magnetic pole magnet 32*a*) and the magnetic pole of the rotor 35*b* of the servo motor 30*b* (position of the magnetic pole in the circumferential direction of the magnetic pole magnet 32*b*) are positioned and mounted symmetrically with each other in the mirror image manner, and the three-phase armature windings Ua, Va, and Wa of the servo motor 30*a* and the three-phase armature windings Ub, Vb, and Wb of the servo motor 30*b* are positioned and mounted symmetrically with each other in the mirror image manner in the circumferential direction.

Figure 3:
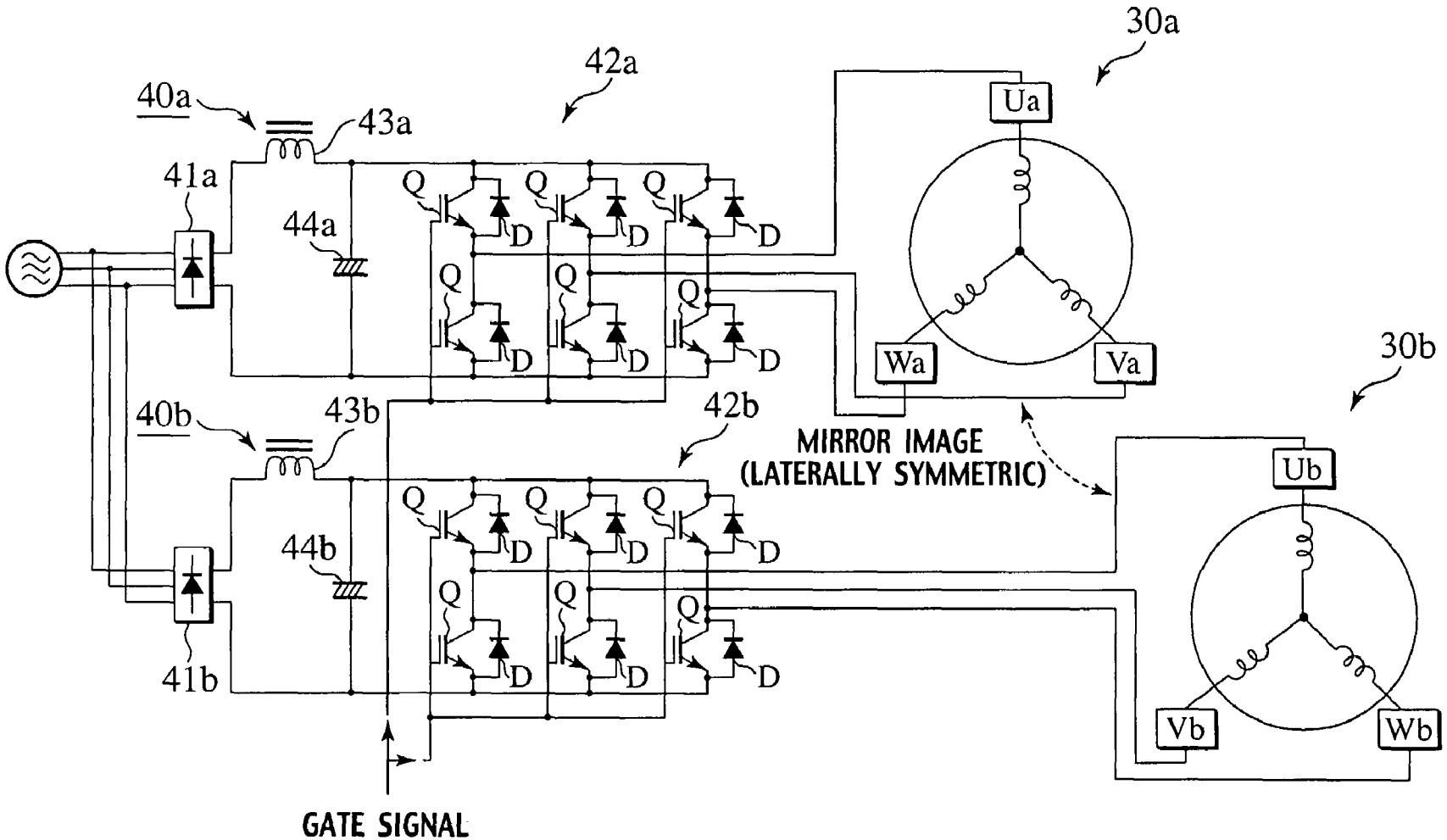
FIG. 3 is a connection diagram showing an example of a structure of a servo motor shown in FIG. 1 and a servo amplifier which drives the servo motor.
Figure 14:
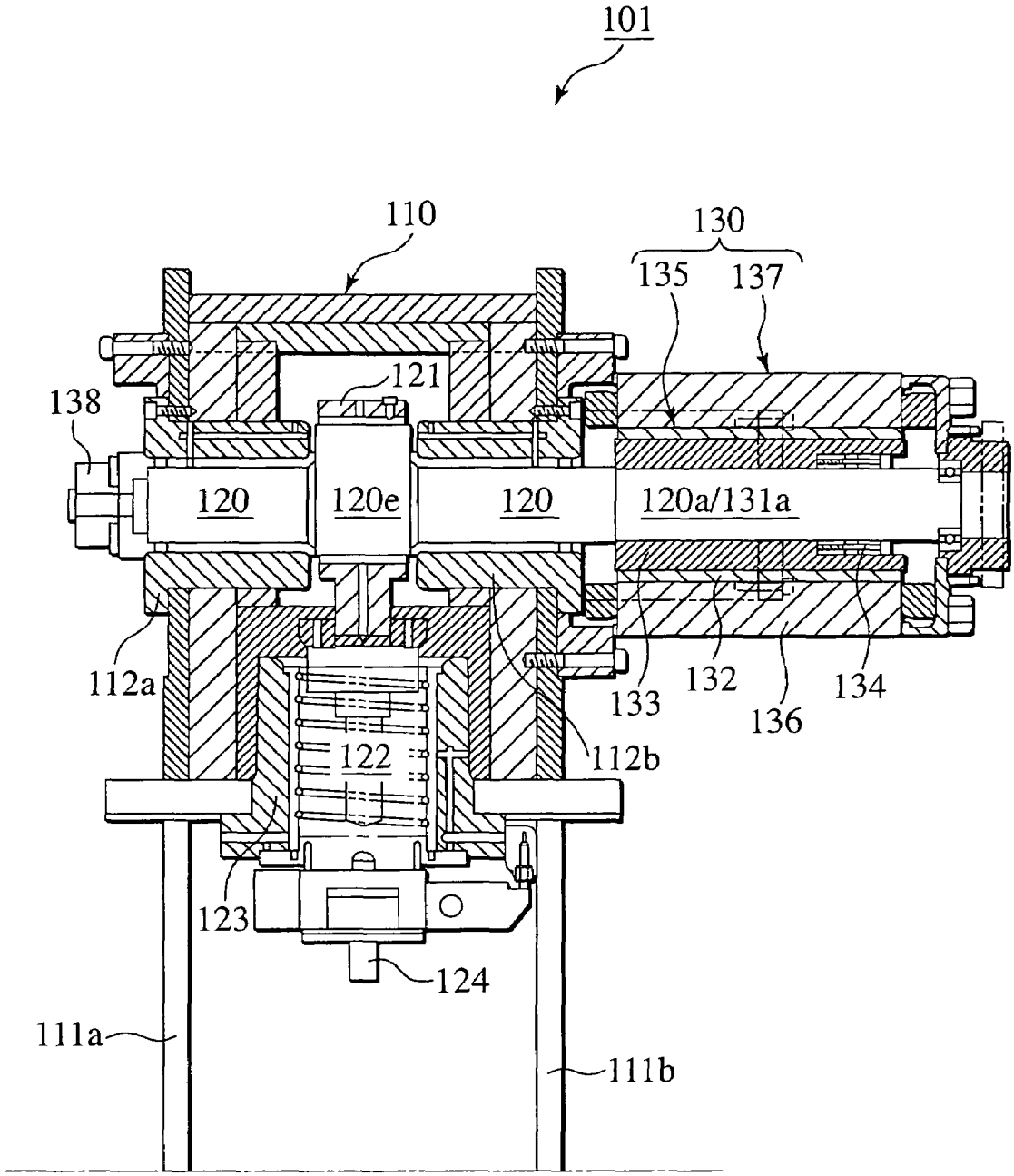
FIG. 14 is a vertical sectional view of an essential portion showing another embodiment of the servo drive system (continuous working system) of the press machine according to the present invention.
Figure 16:
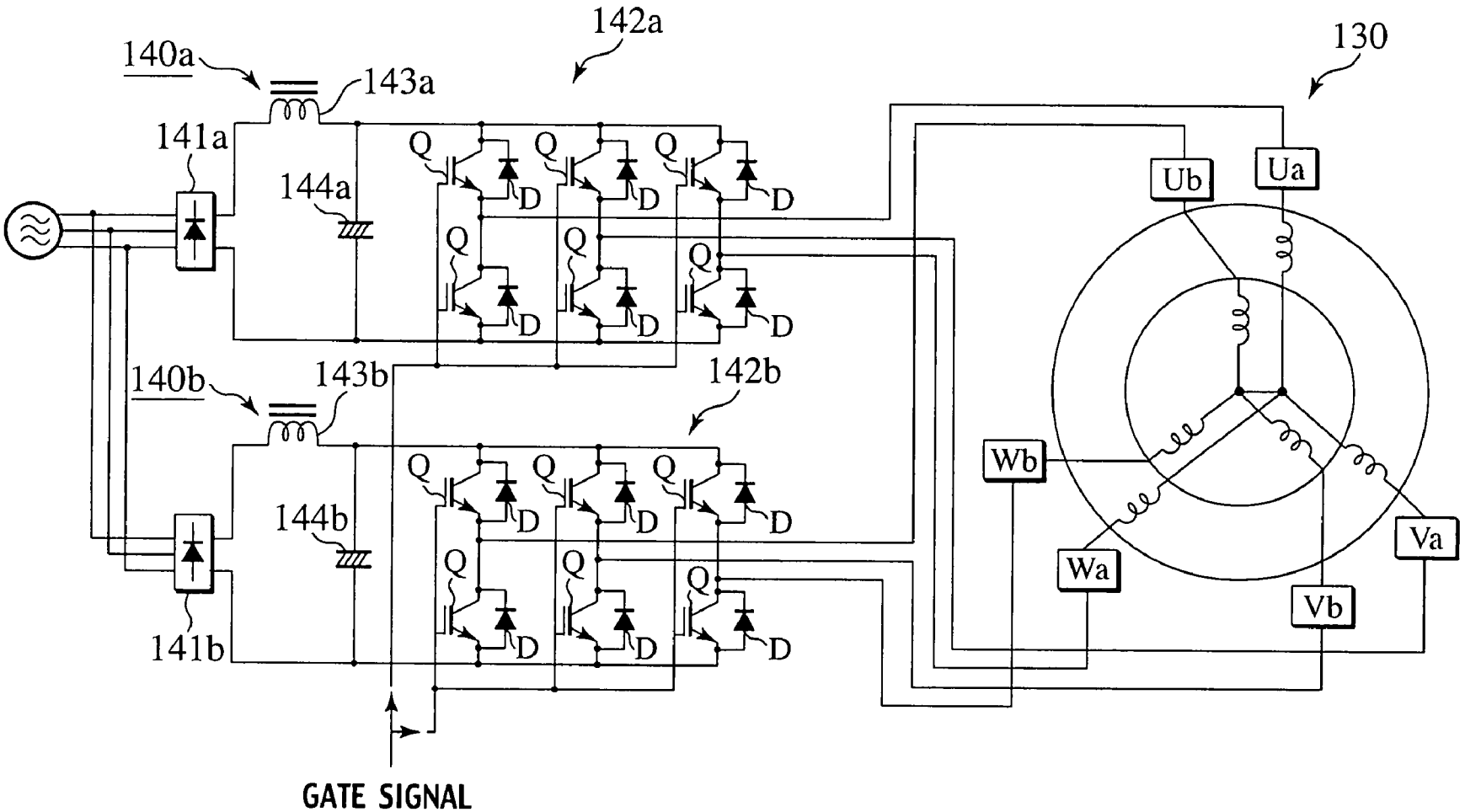
FIG. 16 is a connection diagram showing an example of a structure of a servo motor shown in FIG. 14 and a servo amplifier which drives the servo motor.

Thus, as shown in FIG. 3, if a power driver 42*a* of a servo amplifier 40*a* which is a control circuit of the servo motor 30*a*, and a power driver 42*b* of a servo amplifier 40*b* which is a control circuit of the servo motor 30*b* are driven by the same gate signal, only three-phase alternating current having the same phase and same current values flows to the servo motor 30*a* and the servo motor 30*b*. Therefore, a torque vector of the servo motor 30*a* and a torque vector of the servo motor 30*b* have the same phase and thus, a composite torque of the servo motor 30*a* and the servo motor 30*b* becomes an exact sum of torques of the servo motors 30*a* and 30*b*. This relation is the same irrespective of whether the servo motors 30*a* and 30*b* are separately formed as shown in FIGS. 1 and 3 or the servo motors 30*a* and 30*b* are integrally formed as the three-phase parallel circuit as shown in FIGS. 14 and 16.

As shown in FIG. 3, the servo amplifier 40*a* includes a converter 41*a* which A-D converts three-phase commercial alternating power supply, a power driver 42*a*, a reactor 43*a* which is provided on a front stage of the power driver 42*a* and which suppresses peak current by cutting off high frequency current component, and a capacitor 44*a* for storage having a large capacity. Six power transistors Q of the power driver 42*a* are driven by a gate signal so that the servo amplifier 40*a* drives the servo motor 30*a* by three-phase alternating output of the power driver 42*a*. Diodes D for flowing regenerative current generated during speed reducing period of the servo motor 30*a* are connected to the power transistors Q of the power driver 42*a*. The regenerative current flows into the capacitor 44*a* and is accumulated as regenerative electricity. The capacitor 44*a* supplies electric energy which runs short due to suppression of the peak current by the reactor 43*a* using the regenerative electricity, i.e., the capacitor 44*a* supplies high speed operation electric energy and/or punching out electric energy. The servo amplifier 40*b* has the same structure as that of the servo amplifier 40*a*.

By such control of the servo amplifiers 40*a* and 40*b*, the servo motors 30*a* and 30*b* reciprocate and turn the eccentric shaft 20 through an angle range θ corresponding to a space between positions L and H so that the eccentric shaft portion 20*e* of the eccentric shaft 20 vertically moves between the L position corresponding to a case where the ram 22 is in a predetermined lower end position required for punching working (see FIGS. 4A to 4C) and the H position corresponding to a case where the ram 22 is returned from the L position and is in an upper end position where the striker 24 at a lower end of the ram 22 is separated from an upper surface of the punching die 26. With this, a work is punched.

Figure 4A:
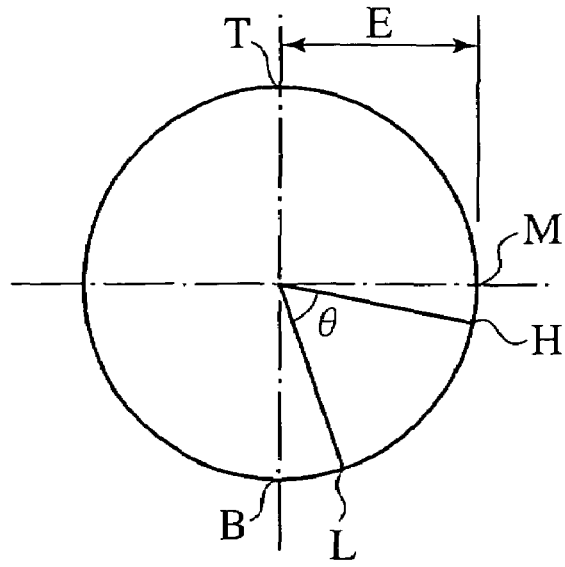
FIGS. 4A, 4B, and 4C are explanatory views showing an operation region of an eccentric shaft portion (ram) of an eccentric shaft.

As shown in FIG. 4A, the L position of the eccentric shaft portion 20*e* of the eccentric shaft 20 corresponding to the lower end position of the ram 22 is set to a position slightly short of and above a bottom dead center B of the entire vertically possible stroke of the ram 22 determined by an eccentric amount E (distance between an axis of the eccentric shaft 20 and an axis of the eccentric shaft portion 20*e*) of the eccentric shaft 20. Further, the H position of the eccentric shaft portion 20*e* of the eccentric shaft 20 corresponding to the upper end position of the ram 22 is set to a position slightly below a medium height M of the entire vertically possible stroke of the ram 22. That is, although the reciprocating turning angle range θ of the eccentric shaft 20 depends on the stroke of the punching die 26 to be used, the angle range θ is set to about 40° to 60°.

Figure 4B:
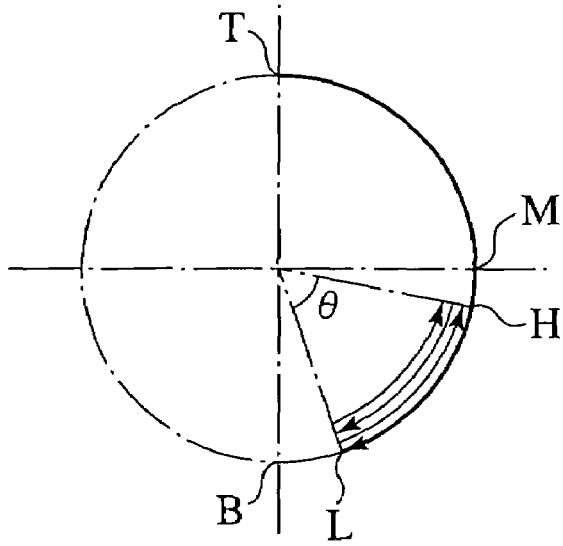

As shown in FIG. 4B, in the servo motors 30*a* and 30*b*, the eccentric shaft portion 20*e* (i.e., ram 22) of the eccentric shaft 20 is positioned on a top dead center T when the die is to be exchanged or the turret is to be rotated. When the working is started, the servo motors 30*a* and 30*b* turn the eccentric shaft portion 20*e* of the eccentric shaft 20 to the L position corresponding to the lower end position of the ram 22 from the top dead center T, thereby lowering the ram 22, and after a first punching working is carried out, the eccentric shaft portion 20*e* is returned to the H position corresponding to the upper end position of the ram 22 where the ram 22 stands-by. In a second or subsequent punching working, the eccentric shaft portion 20*e* of the eccentric shaft 20 is turned such as to reciprocate through the reciprocating turning angle range θ between the H position and the L position.

Figure 4C:
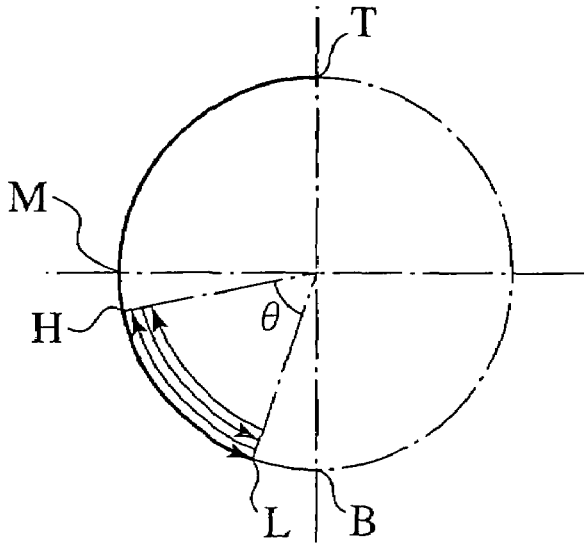

Among the entire rotating range of the eccentric shaft portion 20*e* of the eccentric shaft 20, if a half circumferential range is always used as shown in FIG. 4B, there is an adverse possibility that inconvenience is generated because lubricant oil is not delivered uniformly and various portions are not equally used. To avoid such inconvenience, the servo motors 30*a* and 30*b* are arranged such that the opposite half circumferential range is also used as required as shown in FIG. 4C. It is preferable that the side shown in FIG. 4B and the side shown in FIG. 4C are switched whenever the die is to be exchanged or the turret is to be rotated, or automatically according to a predetermined number of punching operations.

According to the turret punch press 10 of the present embodiment, the pair of servo motors 30*a* and 30*b* are respectively mounted on the outer sides of the frames 11*a* and 11*b*. Therefore, no distortion is generated in mechanical parts corresponding to one side of the eccentric shaft 20. That is, for example, the servo motors 30*a* and 30*b* are integrally formed as one servo motor (30) including a three-phase parallel circuit. The servo motor (30) can be mounted only on the outer side of the frame 11*a* or the frame 11*b*. In this case, since a stress caused by the weight of the servo motor (30) is received only by one frame 11*a* or 11*b*, distortion is generated in both the frames 11*a* and 11*b*, and distortion is generated due to uneven heat generated by the servo motor (30). Further, since the stresses of the bearings 12*a* and 12*b* are also different from each other, it is necessary to deal with this problem. With the turret punch press 10, however, there is a merit that such stress distortion is not generated, and the heat can be dispersed and equalized. Therefore, stable operation can be realized.

As explained above, the servo motors 30*a* and 30*b* directly drive the eccentric shaft 20, and the eccentric shaft 20 continuously reciprocates and turns only in the reciprocating turning angle range θ between the L position corresponding to the lower end position of the ram 22 and the H position corresponding to the upper end position of the ram 22. This operation is extremely effective for speeding up the ram 22 when a work is subjected to continuous punching working.

The operation of the present embodiment will be explained next with reference to explanatory views shown in FIGS. 5 to 13B.

Figure 5:
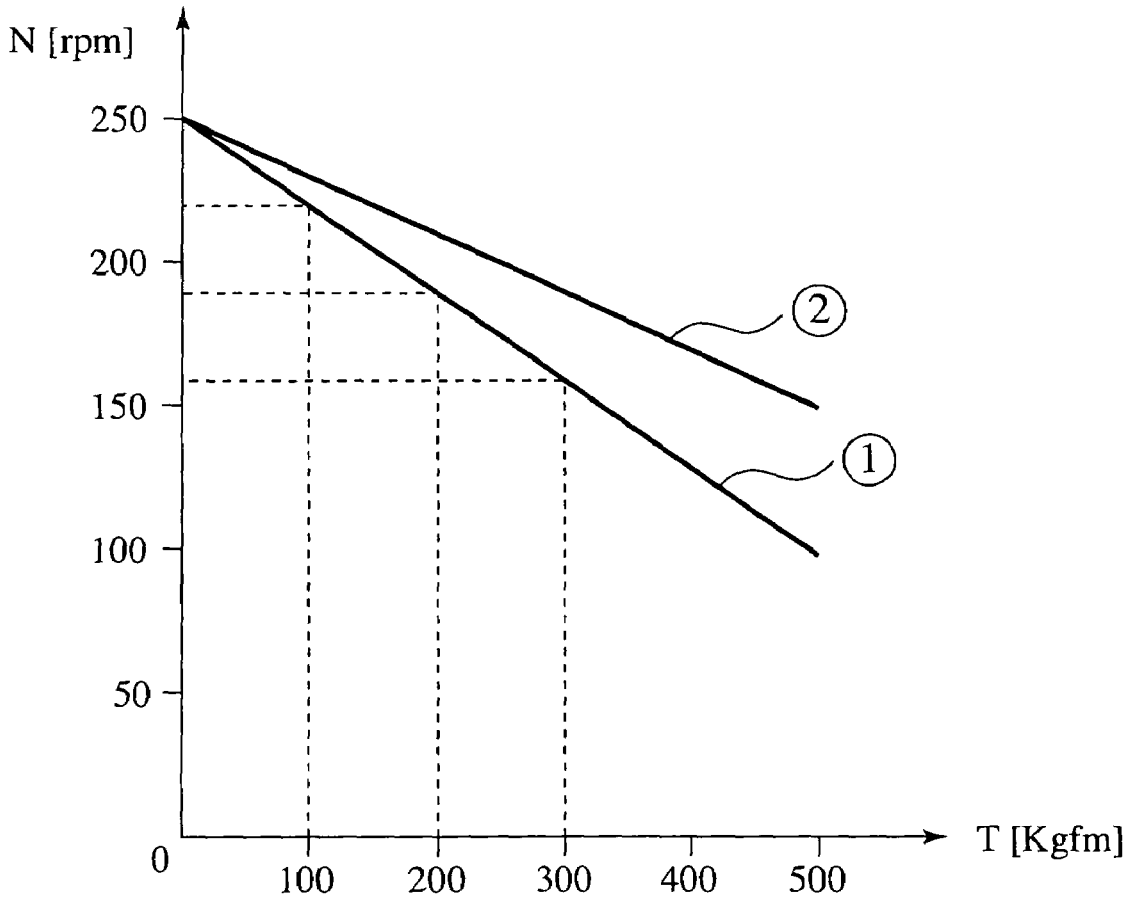
FIG. 5 is a graph showing an example of speed-torque characteristics of the servo motor.

FIG. 5 shows examples 1) and 2) of speed-torque characteristics of the servo motors 30*a* and 30*b*. FIG. 5 shows the upper limit speed at which the servo motors 30*a* and 30*b* can be operated when a driving torque of the ram 22 required for a load applied to the ram 22 is to be generated.

As can be seen from FIG. 5, with the servo motors 30*a* and 30*b*, when a load applied to the ram 22 is light, since the required torque is small, the driving speed of the ram 22 is not reduced and the punching speed of the punching is fast. On the other hand, as the load applied to the ram 22 is heavier, the required torque becomes greater, the driving speed of the ram 22 is reduced, and the punching speed of punching becomes slower. Reasons of generation of noise by punching working are varied depending upon various conditions such as the material of the work, the plate thickness, and the like. However, it is known that the noise is large when the punching speed by driving of a ram is fast, the noise becomes smaller when the punching speed becomes slower, and when the punching speed is constant, the noise is small when the load is light, and as the load becomes heavier, the noise becomes larger. From this fact, like the speed-torque characteristics of the servo motors 30*a* and 30*b* shown in FIG. 5, as the load is heavier, the ram speed becomes slower, and this reduces the noise. Further, it is apparent, from the following actually measured data of punching working of various works and feature extraction waveform data based thereon, that such reduction in ram speed does not deteriorate the operation efficiency.

Figure 6:
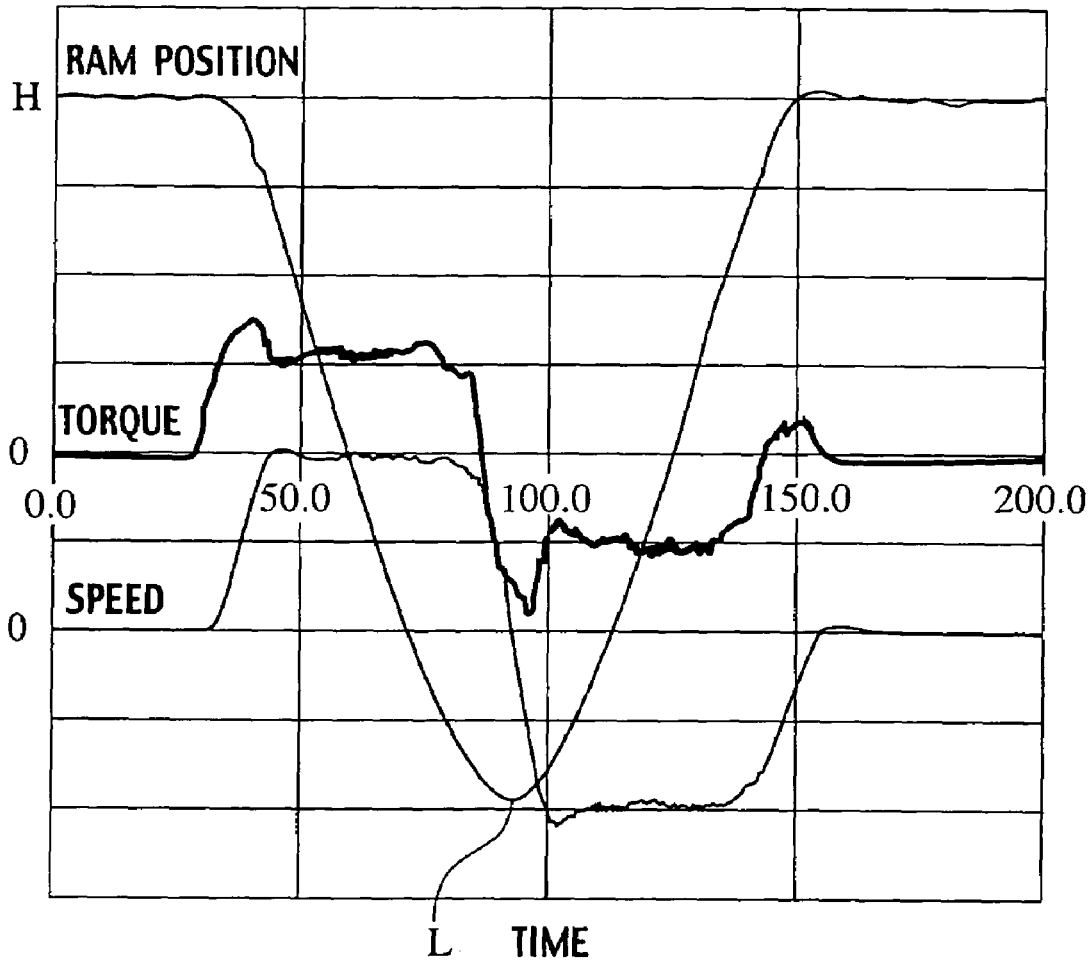
FIG. 6 is a diagram showing actually measured data of a punching working when there is no work.
Figure 7A:
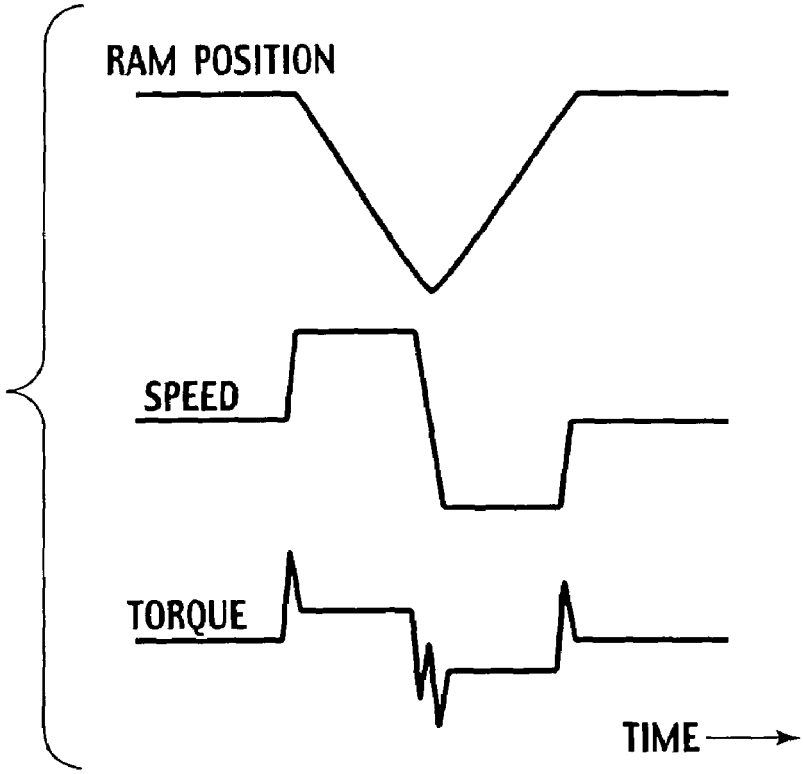
FIG. 7A is a diagram showing feature extraction waveform data based on the actually measured data shown in FIG. 6.
Figure 7B:
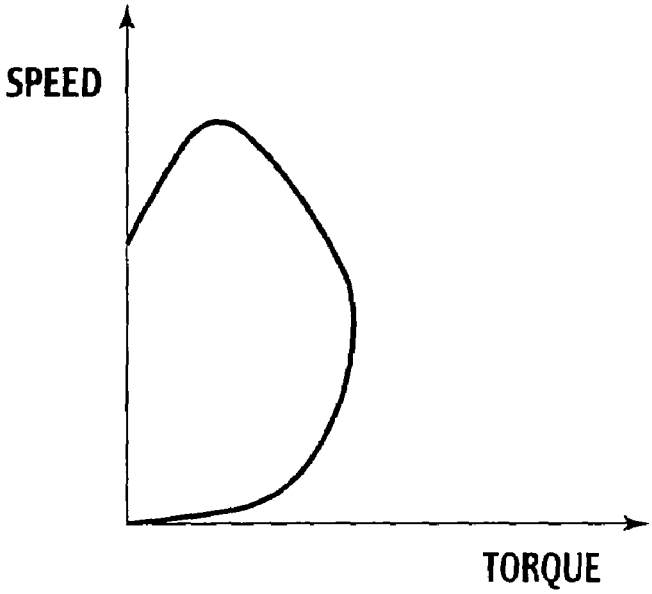
FIG. 7B is a diagram showing punching torque-speed characteristics based on the actually measured data shown in FIG. 6.

FIG. 6 shows the actually measured data of a punching working when there is no work, FIG. 7A shows the feature extraction waveform data based on the actually measured data, and FIG. 7B shows the punching torque-speed characteristics based on the actually measured data.

As shown in FIGS. 6, 7A, and 7B, when there is no work, in a first half of one cycle of the ram 22, a speed curve and a torque curve rise in a normal rotation direction to keep constant values. With this, a ram position curve is substantially uniformly lowered from the upper end position (corresponding to H position) to the lower end position (corresponding to L position). Next, in a second half of the one cycle of the ram 22, the speed curve and the torque curve rise in the reverse rotation direction to keep the constant values. With this, the ram position curve is substantially uniformly moved upward from the lower end position (corresponding to L position) to the upper end position (corresponding to H position).

Figure 8:
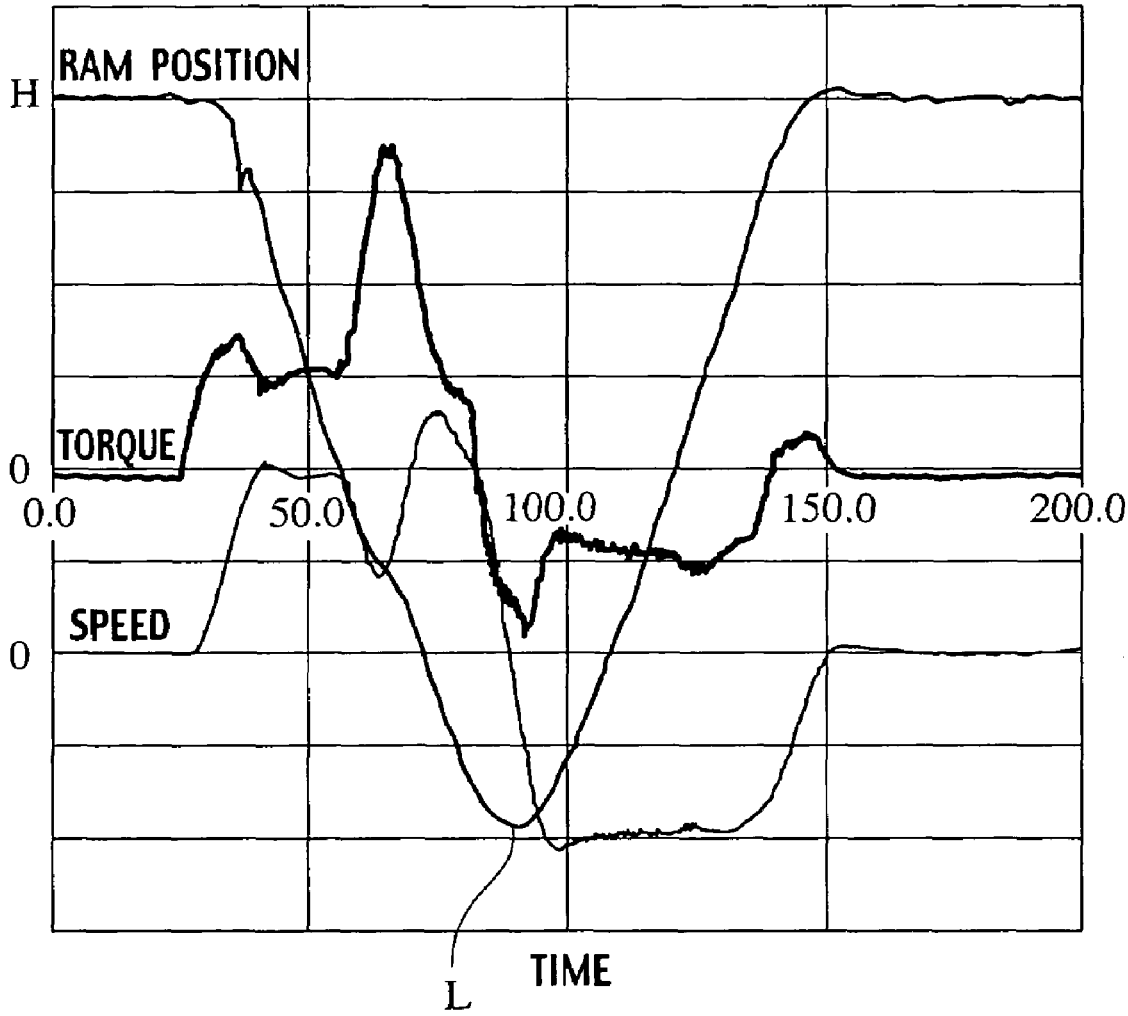
FIG. 8 is a diagram showing actually measured data of a punching working when a thin plate work is punched out using a punch having a small diameter.
Figure 9A:
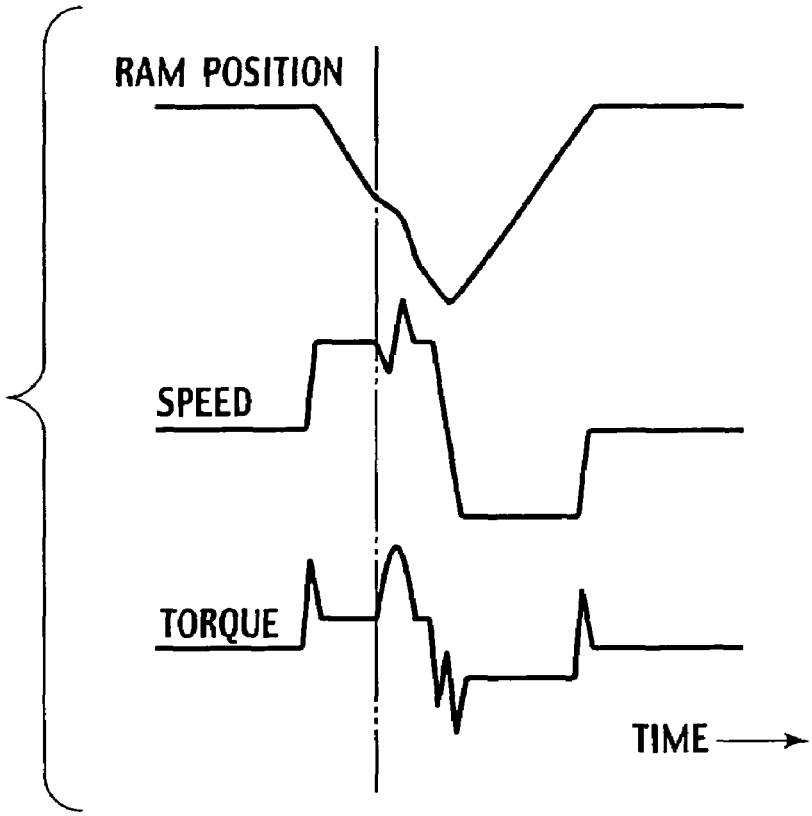
FIG. 9A is a diagram showing the feature extraction waveform data based on the actually measured data shown in FIG. 8.
Figure 9B:
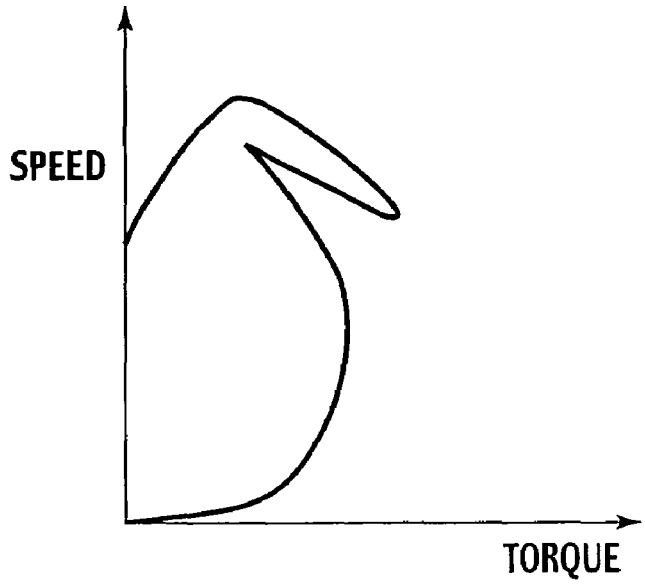
FIG. 9B is a diagram showing punching torque-speed characteristics based on the actually measured data shown in FIG. 8.

FIG. 8 shows the actually measured data of a punching working when a thin plate work is punched out using a punch having a small diameter, FIG. 9A shows the feature extraction waveform data based on the actually measured data, and FIG. 9B shows the punching torque-speed characteristics based on the actually measured data.

As shown in FIGS. 8 to 9B, when the thin plate work is punched out using the punch having the small diameter, the behavior in the first half of one cycle of the ram 22 is different from that in the case shown in FIGS. 6 to 7B. That is, in the initial operation, like the case shown in FIGS. 6 to 7B, the speed curve and the torque curve rise in the normal rotation direction to the constant values. With this, the ram position curve starts lowering substantially uniformly from the upper end position (corresponding to H position). However, if the striker 24 of the lower end of the ram 22 pushes the punching die 26 and a tip end of the punching die 26 abuts against an upper surface of the work and the striker 24 receives a load from the work, the torque curve abruptly rises and the speed curve is reduced and with this, the lowering motion of the ram position curve becomes moderate (slow). If the tip end of the punching die 26 lowers to a position short of a lower surface of the work and the load received from the work is abruptly reduced, the torque curve abruptly lowers, the speed curve is accelerated beyond the constant value to restore the speed reduction and with this, the lowering speed of the ram position curve is also accelerated. Thereafter, in the second half of one cycle of the ram 22, like the case shown in FIGS. 6 to 7B, the ram position curve substantially uniformly rises from the lower end position (corresponding to L position) to the upper end position (corresponding to H position).

Figure 10:
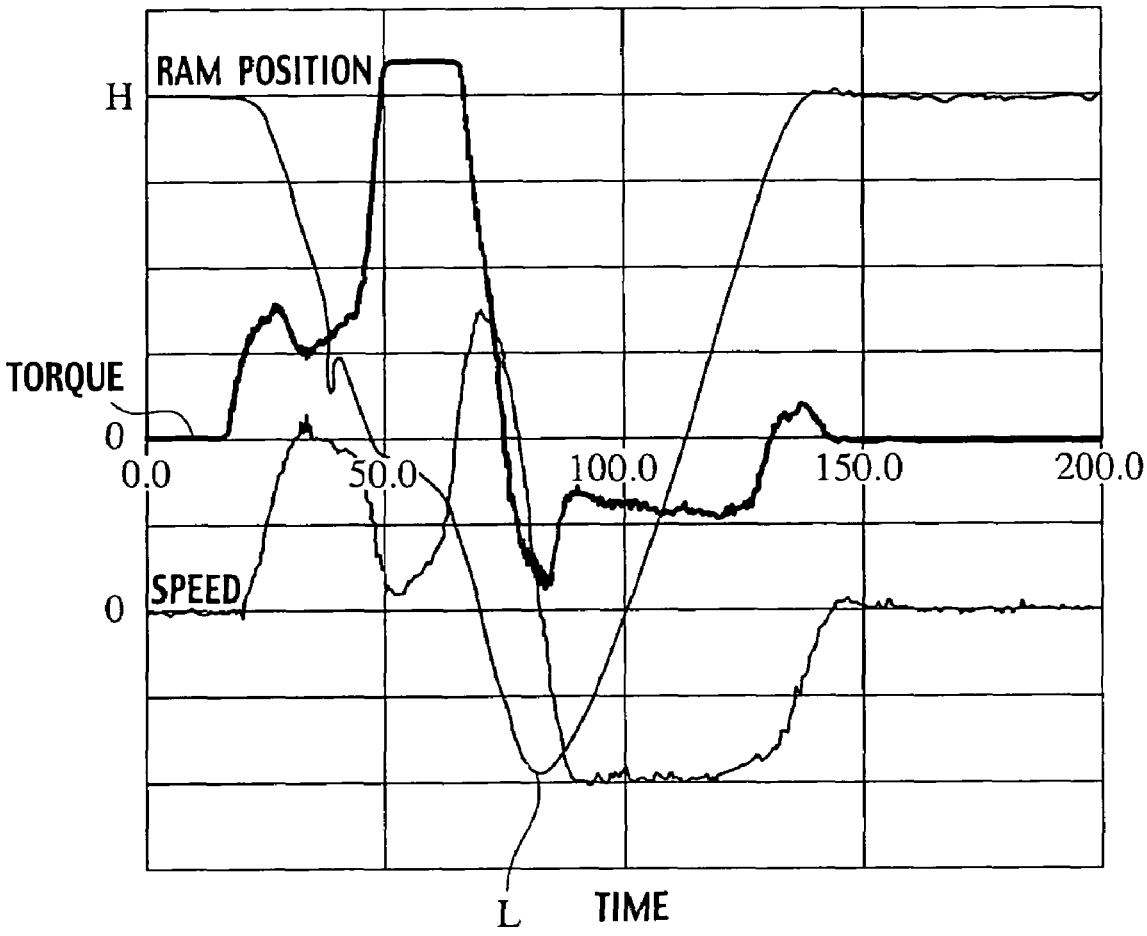
FIG. 10 is a diagram showing actually measured data of a punching working when a thin plate work is punched out using a punch having a large diameter.
Figure 11A:
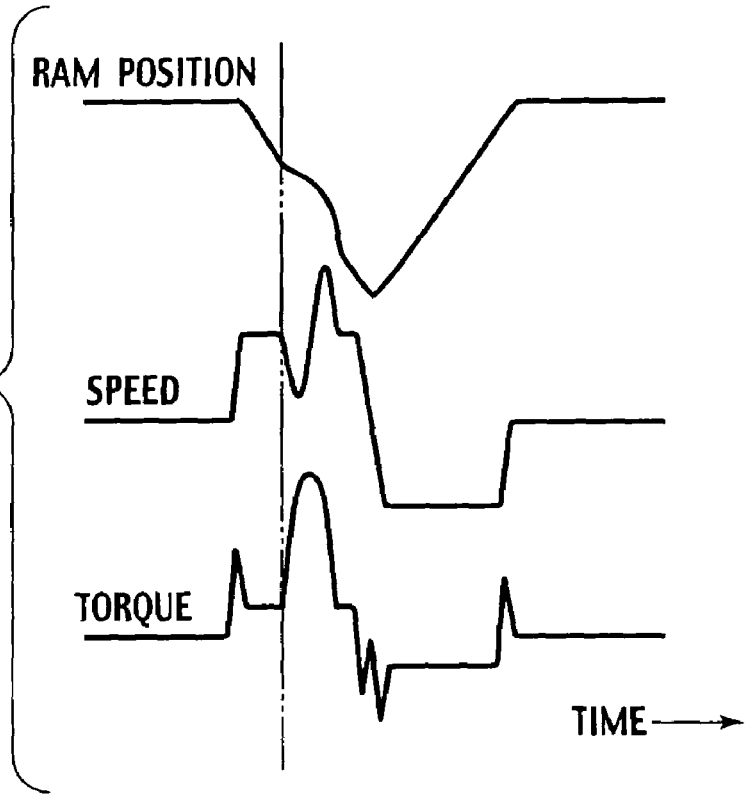
FIG. 11A is a diagram showing the feature extraction waveform data based on the actually measured data shown in FIG. 10.
Figure 11B:
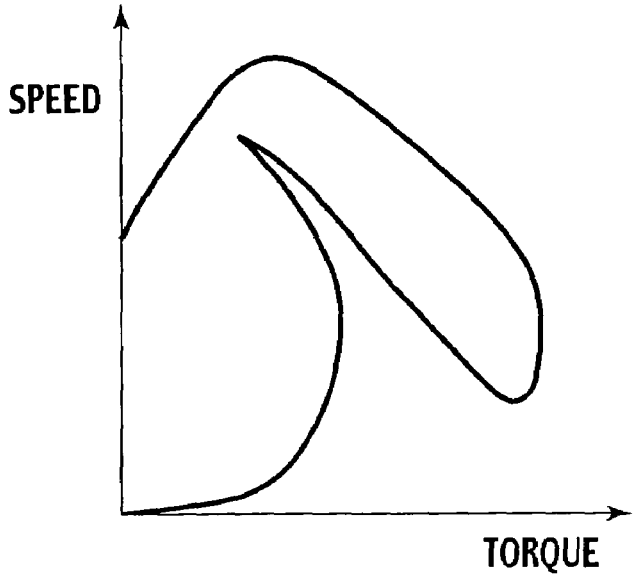
FIG. 11B is a diagram showing the punching torque-speed characteristics based on the actually measured data shown in FIG. 10.

FIG. 10 shows the actually measured data of a punching working when a thin plate work is punched out using a punch having a large diameter, FIG. 11A shows the feature extraction waveform data based on the actually measured data, and FIG. 11B shows the punching torque-speed characteristics based on the actually measured data.

As shown in FIGS. 10 to 11B, when a thin plate work is punched out using a punch having a large diameter, the behavior in the first half of one cycle of the ram 22 is different from that in the case shown in FIGS. 8 to 9B. That is, in the initial operation, like the case shown in FIGS. 8 to 9B, the speed curve and the torque curve rise in the normal rotation direction to the constant values. With this, the ram position curve starts lowering substantially uniformly from the upper end position (corresponding to H position). However, if the striker 24 of the lower end of the ram 22 pushes the punching die 26 and load from the work is received, since the diameter of the punch is larger than that shown in FIGS. 8 to 9B, a load received from the work is great and thus, the torque curve rises largely as compared with the case shown in FIGS. 8 to 9B, and the speed curve reduces largely as compared with the case shown in FIGS. 8 to 9B. With this, the lowering motion of the ram position curve becomes much more moderate (slower) than that shown in FIGS. 8 to 9B. If the tip end of the punching die 26 lowers to a position short of the lower surface of the work and the load received from the work is abruptly reduced, the torque curve abruptly lowers, the speed curve is accelerated larger than that shown in FIGS. 8 to 9B so as to restore the speed reduction and with this, the lowering speed of the ram position curve is also accelerated larger than that shown in FIGS. 8 to 9B. Thereafter, in the second half of one cycle of the ram 22, like the case shown in FIGS. 8 to 9B, the ram position curve substantially uniformly rises from the lower end position (corresponding to L position) to the upper end position (corresponding to H position).

Figure 12:
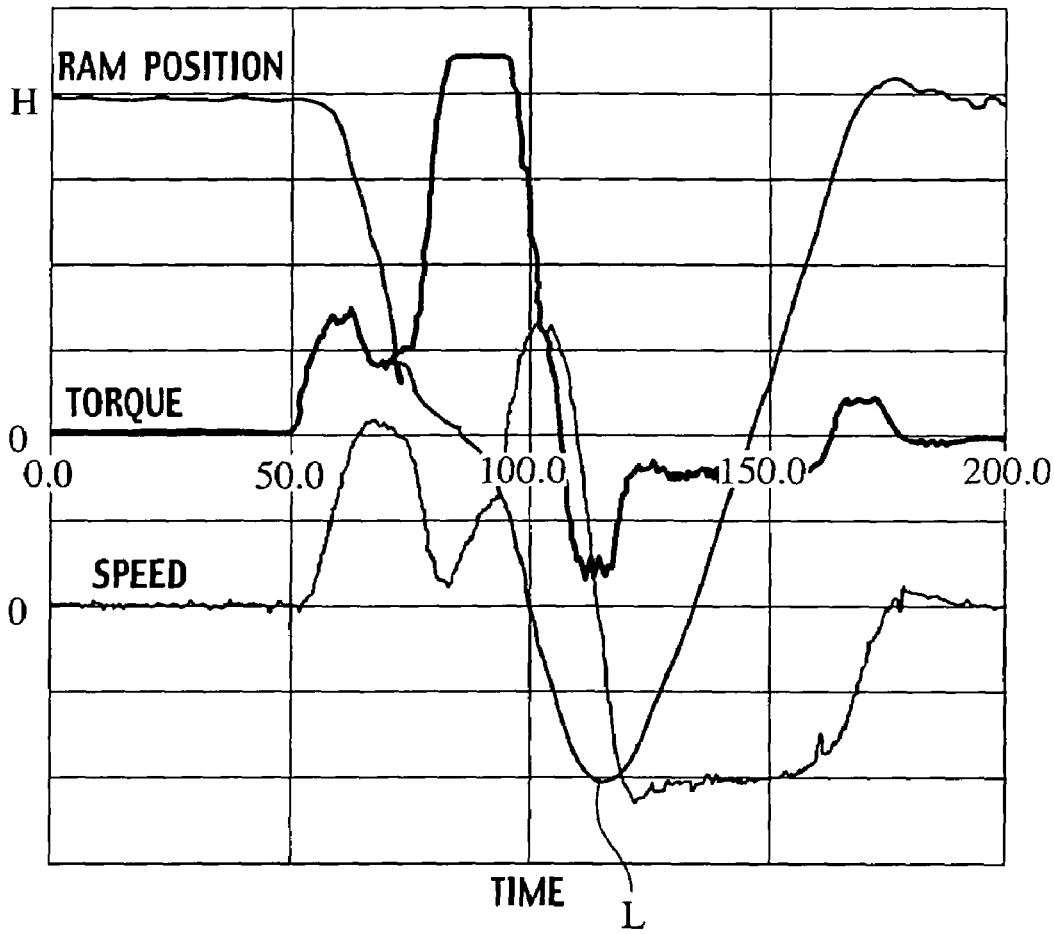
FIG. 12 is a diagram showing actually measured data of a punching working when a thick plate work is punched out using a punch having a small diameter.
Figure 13A:
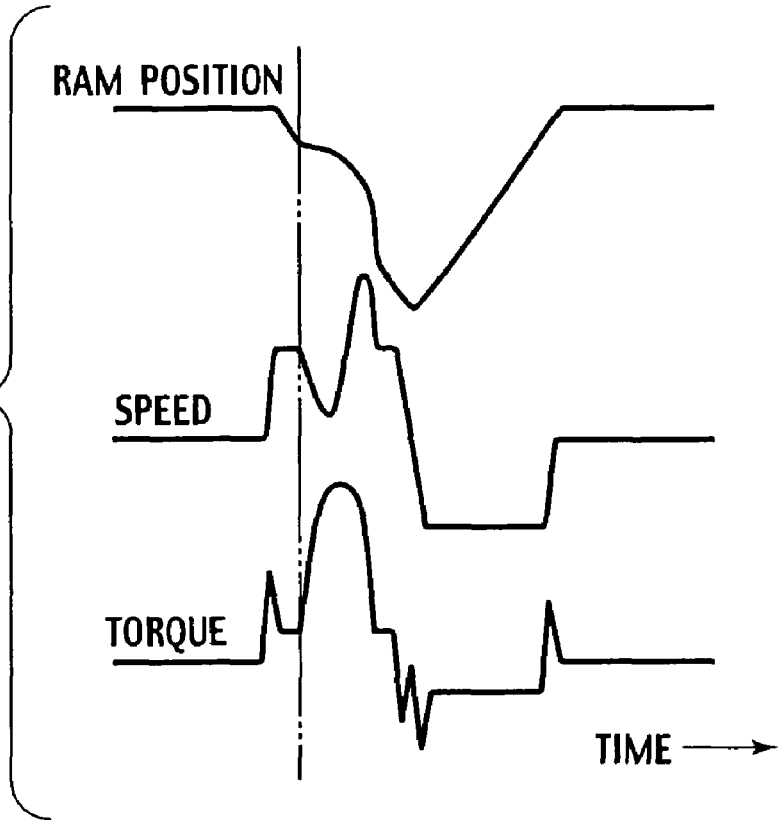
FIG. 13A is a diagram showing the feature extraction waveform data based on the actually measured data shown in FIG. 12.
Figure 13B:
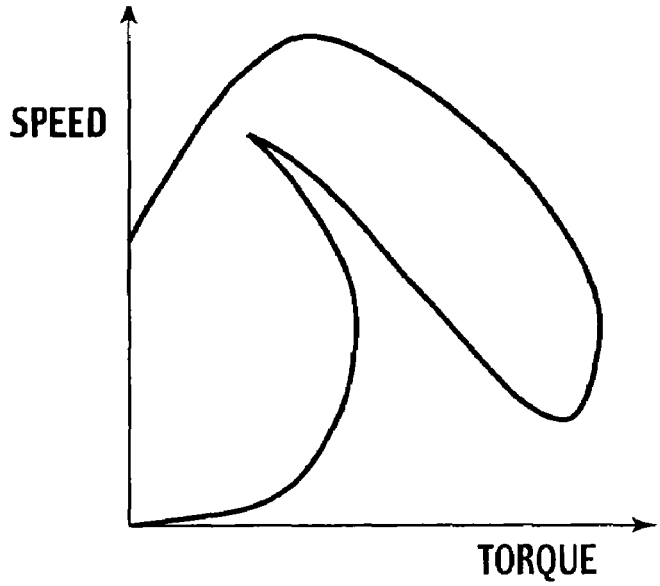
FIG. 13B is a diagram showing the punching torque-speed characteristics based on the actually measured data shown in FIG. 12.

FIG. 12 shows the actually measured data of a punching working when a thick plate work is punched out using a punch having a small diameter, FIG. 13A shows the feature extraction waveform data based on the actually measured data, and FIG. 13B shows the punching torque-speed characteristics based on the actually measured data.

As shown in FIGS. 12 to 13B, when a thick plate work is punched out using a punch having a small diameter, since the plate of the work is thicker as compared with the case shown in FIGS. 8 to 9B, a load received from the work is greater. Therefore, the behavior in the first half of one cycle of the ram 22 is different from that of the case shown in FIGS. 8 and 9, but the difference is not great as compared with the case shown in FIGS. 10 to 11B.

If the speed curve is reduced depending upon the magnitude of the load applied to the ram 22 and the lowering motion of the ram position curve becomes moderate (slow), the speed curve is accelerated beyond the constant value to restore the speed reduction, and the lowering speed of the ram position curve is also accelerated, and the reduction in ram speed caused by the load is absorbed and overcome as acceleration and deceleration in one cycle of the ram 22. Therefore, time required through one cycle of the ram 22 is substantially the same, and this does not hinder the speed up of the ram 22.

Such speed-torque characteristics of the motor can be explained as follows. The motor converts the supplied electric energy into energy applied to a load. With the servo motors 30*a* and 30*b*, the magnitude of the supplied electric energy is determined by the servo amplifiers 40*a* and 40*b*, voltage of power supply is also limited, and voltage equal to or greater than the power supply voltage can not be applied.

On the other hand, with the servo motors 30*a* and 30*b*, energy applied to a load, i.e., the motor torque carries out the punching action of the punching during the lowering operation of the ram in a cycle where the normal rotation of appropriate acceleration which lowers the ram 22 and the reverse rotation of the appropriate acceleration which moves the ram 22 upward are repeated. Therefore, the motor torque can be divided into a torque for generating kinetic energy of the ram 22 and a torque for generating the punching pressurizing force.

In such a case, if the acceleration is very slow (if the vertical movement of the ram 22 is delayed), a small amount of kinetic energy generating torque suffices and thus, almost all of the motor torque can be utilized as the pressurizing force generating torque. Therefore, even if a great pressurizing force is required depending upon the conditions such as the plate thickness and material of the work, sufficient pressurizing force can be generated, and the kinetic energy generating torque does not come short and the speed of the ram 22 is not affected.

In actual practice, since high acceleration to some extent (fast vertical movement of the ram 22) is required for the operation efficiency, the amount of pressurizing force generating torque of the motor torque is limited. Therefore, if a great pressurizing force is required depending upon the conditions such as the plate thickness and material of the work, most of the motor torque is used for generating the pressurizing force, the kinetic energy generating torque comes short, the speed of the ram 22 can not be maintained, and the lowering speed of the ram 22 is reduced.

However, the deceleration of the lowering speed of the ram 22 is the characteristic which is extremely effective for reducing a noise caused by the punching operation of punching, a noise caused by vibration, and vibration itself. That is, when the required pressurizing force (the number of pressure tons) is relatively small depending upon the conditions such as the plate thickness and material of the work, since the speed reduction of the lowering speed of the ram 22 is small, the punching action with light load becomes relatively fast. When the required pressurizing force (the number of pressure tons) is relatively large, since the speed reduction of the lowering speed of the ram 22 is large, the punching action with heavy load becomes relatively slow. The variation in punching speed is automatically determined according to the required pressurizing force (the number of pressure tons). Thus, a command of punching pattern (lowering pattern of the ram 22) by the number of punching tons is not necessary. That is, it becomes impossible to maintain the lowering speed of the ram 22 and with this, optimal punching pattern (lowering pattern of the ram 22) is automatically produced.

Conversely, the speed-torque characteristics of the servo motors 30*a* and 30*b* to be used are set such that motor torques of the servo motors 30*a* and 30*b* at which the capacity of the electric energy supplied by the servo amplifiers 40*a* and 40*b* is determined become motor torques at which an optimal punching pattern (lowering pattern of the ram 22) is generated from a light load to a heavy load according to the type of work to be worked on by the turret punch press 10. With this, a noise caused by the punching action of punching, a noise caused by vibration, and the vibration itself can be reduced.

In an electric punch press in which a mechanism such as a toggle and a flywheel is not used and a motor and a ram operation shaft are directly connected to each other, it can be said that the punch press that can reduce a noise caused by the punching action of punching, a noise caused by vibration, and the vibration itself based on the explanation with reference to FIGS. 5 to 13B has the same speed-torque characteristics as those of the servo motors 30*a* and 30*b* of the servo drive system (continuous working system) 1 according to the present invention.

The operation of the reactors 43*a* and 43*b* and the capacitors 44*a* and 44*b* of the servo amplifiers 40*a* and 40*b* will be explained.

If a value of each of the reactors 43*a* and 43*b* is defined as L, since the impedance Z is $Z=2\pi fL$, a resistance is high to a high frequency component. For this reason, the peak current of the reactors 43*a* and 43*b* can be suppressed by cutting off the high frequency current component. With this, since the peak electricity of the servo amplifiers 40*a* and 40*b* can be suppressed, if reactors 43*a* and 43*b* having extremely large L values are used, the peak electricity can be adjusted to such a value that it is substantially unnecessary to change contracted electric power with respect to a power company, as compared with a case where a mechanism such as a toggle and a flywheel is utilized.

However, in the case of the punching working using a punch press, in order to move, at high speed, the eccentric shaft 20 which vertically moves the ram 22, large kinetic energy is required, and its frequency is also high. Thus, if the L values of the reactors 43*a* and 43*b* become significantly large, there is an adverse possibility that high speed operation electric energy can not be supplied from the servo amplifiers 40*a* and 40*b* to the servo motors 30*a* and 30*b* in time. In the case of the punching working using the punch press, since large punching energy is required at the time of the punching working, if the L values of the reactors 43*a* and 43*b* become significantly large, there is an adverse possibility that the supply of the punching operation electric energy from the servo amplifiers 40*a* and 40*b* to the servo motors 30*a* and 30*b* becomes insufficient.

To complement the supply of the high speed operation electric energy and/or the supply of the punching operation electric energy from the servo amplifiers 40*a* and 40*b* to the servo motors 30*a* and 30*b*, there are provided the capacitors 44*a* and 44*b*. If the capacitors 44*a* and 44*b* having significantly large capacity are used, electric energy required for the high speed operation and/or electric energy required for the punching operation can sufficiently be supplied from the servo amplifiers 40*a* and 40*b* to the servo motors 30*a* and 30*b*.

Therefore, if the reactors 43*a* and 43*b* having the significantly large L values and the capacitors 44*a* and 44*b* having the significantly large capacity are used, the peak electricity can be reduced as desired, and the high speed punching working can be carried out according to proper performance of the turret punch press 10.

Although both the servo motors 30*a* and 30*b* are integrally operated in the present embodiment, the present invention is not limited to this. For example, when the load is extremely light and a work can sufficiently be subjected to the working using torque of one of the servo motors 30*a* and 30*b*, only one of them may be energized and operated. With this, as compared with when both the servo motors 30*a* and 30*b* are integrally operated with respect to such an extremely light load, there is a possibility that the lowering speed of the ram 22 becomes moderate and the noise is reduced, and power may be saved. However, it is preferable to take necessary measures against heat such as cooling.

Figure 15:
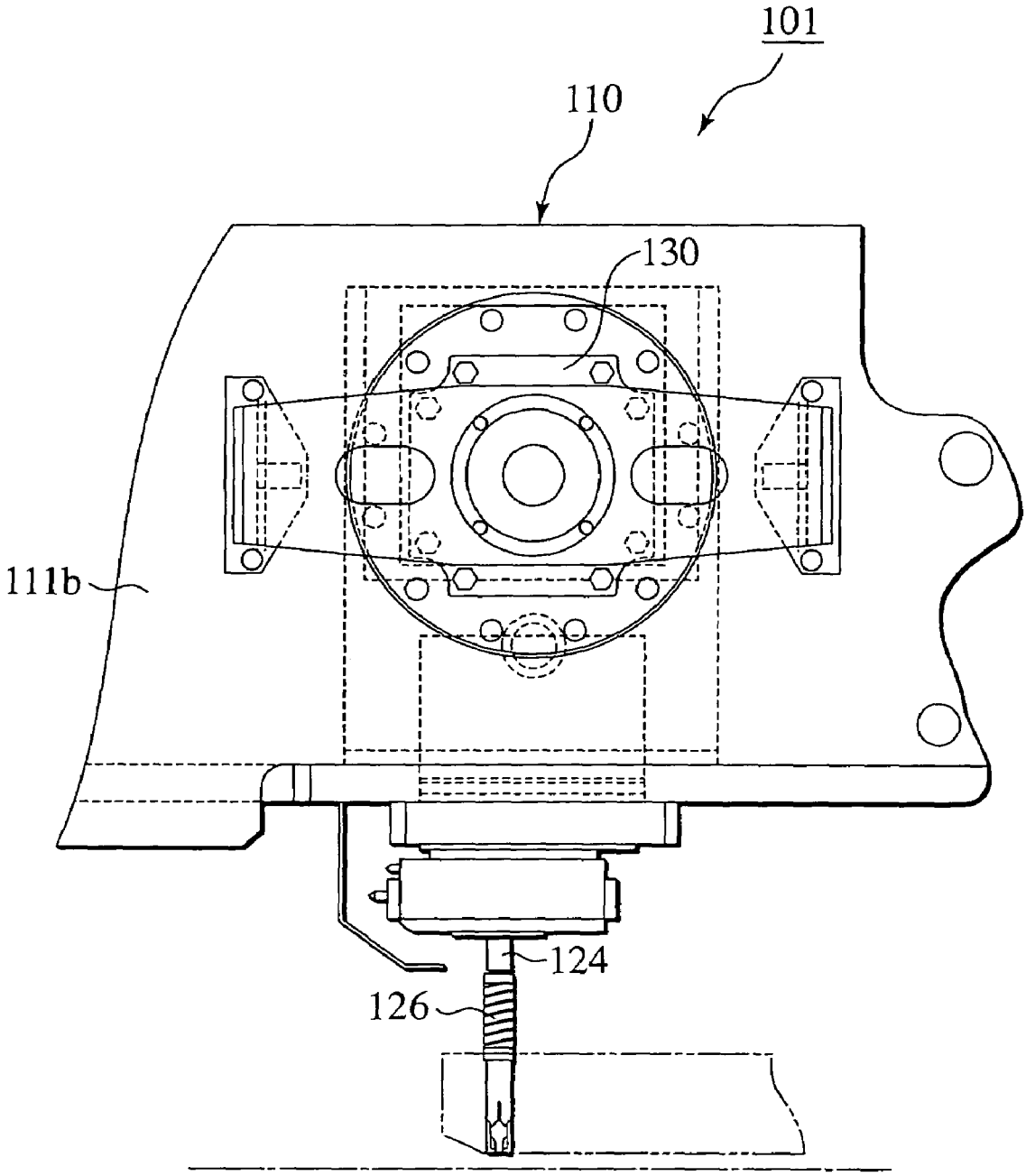
FIG. 15 is a right side view of an essential portion shown in FIG. 14.

FIG. 14 is a vertical sectional view of an essential portion showing another embodiment of the servo drive system (continuous working system) of the press machine according to the present invention, and FIG. 15 is a right side view of the essential portion. A servo drive system (continuous working system) 101 of this press machine is applied to a turret punch press 110.

As shown in FIG. 16, the turret punch press 110 uses one servo motor 130 which integrally includes servo motors 30*a* and 30*b* as a three-phase parallel circuit instead of the pair of servo motors 30*a* and 30*b*. The turret punch press 110 has the same speed-torque characteristics as those of the servo motors 30*a* and 30*b*. Thus, the servo motor 130 is larger than one of the servo motors 30*a* and 30*b* in size and correspondingly, an eccentric shaft 120 is formed only at its one end with an extension 120*a* extending longer than the extension 20*a*. A servo motor 130 using this extension 120*a* as a motor main shaft 131 is mounted on an outer side of a frame 111*a*. Other structures of the servo drive system (continuous working system) 101 of the press machine are the same as those of the servo drive system (continuous working system) 1 of the press machine shown in FIGS. 1 and 2. Therefore, the elements of the servo drive system (continuous working system) 101 which are the same as those of the system shown in FIGS. 1 and 2 are designated with the reference numbers to which 100 is added, and detailed explanation of the structures of various portions of the servo drive system (continuous working system) 101 of the press machine will be omitted. The operation of the servo drive system (continuous working system) 101 of the press machine is also the same as that of the servo drive system (continuous working system) 1 of the press machine.

If a single drive turret punch press 110 having only one servo motor 130 and a twin drive turret punch press 10 having a pair of servo motors 30*a* and 30*b* are compared with each other, there are following differences. That is, in the single drive turret punch press 110, since a stress caused by the weight of the servo motor 130 is received only by the frame 111*b*, distortion is generated in the frames 111*a* and 111*b*. Further, a distortion caused by non-uniform heat is also generated by the heat of the servo motor 130. Stresses of the bearings 112*a* and 112*b* are also different from each other. Therefore, it is necessary to take measures against the problems. On the other hand, in the twin drive turret punch press 10, there is a merit that a stress distortion is not generated, and heat is dispersed and averaged.

Although the opposite end extensions 20*a* and 20*b* themselves of the eccentric shaft 20 serve as the main shafts 31*a* and 31*b* of the servo motors 30*a* and 30*b* in the present embodiment, the present invention is not limited to this. If necessary, for example, the eccentric shaft 20 and the main shafts 31*a* and 31*b* may be formed as separate members, the main shafts 31*a* and 31*b* may respectively be connected to the opposite ends of the eccentric shaft 20 using bolts or other appropriate means, and they may be formed as one member. The eccentric shaft 120 and the main shaft 131 of the servo motor 130 may also be formed in this manner.

Although the servo drive systems (continuous working systems) 1 and 101 are applied to the turret punch presses 10 and 110 in the embodiment, the present invention is not limited to this, and the system can also be applied to various press machines other than the punch press.

The disclosures of Japanese Patent Application Nos. 2002-177143 (filed on Jun. 18, 2002), 2002-177150 (filed on Jun. 18, 2002), 2002-177149 (filed on Jun. 18, 2002), 2003-145372 (filed on May 22, 2003), 2003-145374 (filed on May 22, 2003), 2003-145377 (filed on May 22, 2003), and 2002-177145 (filed on Jun. 18, 2002) are incorporated by reference herein in their entirety.

The embodiments of the present invention disclosed above are to be considered not restrictive, changes can be appropriately made, and the invention may be embodied in other specific forms.

The invention claimed is:

1. A servo drive system of a press machine, comprising:

a ram;

an operation shaft which vertically moves the ram;

a pair of servo motors which are formed symmetric to each other at opposite ends of the operation shaft, which operate as power sources of the ram, and which composite torques based in common on at least one speed-torque characteristic to generate ram pressure, a servo amplifier of one of the pair of servo motors, comprising a power unit; and a servo amplifier of the other of the pair of servo motors, comprising a power unit, wherein the pair of servo motors are operated integrally so that the pair of servo motors directly drive the operation shaft to vertically move the ram, and wherein the power unit of the servo amplifier of the one of the pair of servo motors and the power unit of the servo amplifier of the other of the pair of servo motor are driven by a common gate signal to integrally operate both of the pair of servo motors.

2. The servo drive system according to claim 1, wherein the pair of servo motors use a torque based on speed-torque characteristics of a motor, and wherein, if a load is received from a work during a process of lowering the ram to generate ram pressure without utilizing inertia of a mechanism, speeds of both the pair of servo motors are reduced according to the load, thereby reducing a lowering speed of the ram.

3. The servo drive system according to claim 1, wherein the operation shaft comprises an eccentric shaft formed as a motor main shaft.

4. The servo drive system according to claim 3, further comprising:

a left extension of the eccentric shaft;

a right extension of the eccentric shaft;

a first sleeve, fitted over a periphery of the left extension of the eccentric shaft and provided at an outer periphery with an even number of magnetic pole magnets along a circumferential direction at predetermined distances from one another, a second sleeve, fitted over a periphery of the right extension of the eccentric shaft and provided at an outer periphery with an even number of magnetic pole magnets along a circumferential direction at predetermined distances from one another, wherein the first sleeve and the second sleeve form rotors of the pair of servo motors, wherein magnetic pole positions of the left sleeve and the right sleeve are positioned such that the sleeves are symmetric with each other;

wherein the first sleeve and the second sleeve are fixed by bushes, wherein stators of the pair of servo motors have outer cylinders fitted over the rotors;

wherein three-phase armature windings are wound around the outer cylinders, and wherein left and right outer cylinders are positioned such that positions of the three-phase armature windings of the outer cylinders in the circumferential direction are symmetric with each other, and the outer cylinders are fixed to left and right supporting frames of the eccentric shaft.

5. The servo drive system according to claim 3, further comprising:

a left extension of the eccentric shaft;

a right extension of the eccentric shaft;

a first sleeve, fitted over a periphery of the left extension of the eccentric shaft and provided at an outer periphery with an even number of magnetic pole magnets along a circumferential direction thereof at predetermined distances from one another;

a second sleeve, fitted over a periphery of the right extension of the eccentric shaft and provided at an outer periphery with an even number of magnetic pole magnets along a circumferential direction thereof at predetermined distances from one another;

wherein the first sleeve and the second sleeve form rotors of the pair of servo motors, wherein magnetic pole magnets of the left sleeve and the right sleeve are positioned in a circumferential position such that the sleeves are symmetric with each other;

wherein the first sleeve and the sleeves are fixed by bushes, wherein stators of the pair of servo motors have outer cylinders fitted over the rotors;

wherein three-phase armature windings are wound around the outer cylinders, and wherein left and right outer cylinders are positioned such that positions of the three-phase armature windings of the outer cylinders in the circumferential direction are symmetric with each other, and the outer cylinders are fixed to left and right supporting frames of the eccentric shaft.

6. A servo drive system of a press machine, comprising:

a servo motor which operates as a driving source of a ram, wherein the servo motor uses a torque based on speed-torque characteristics of a motor, wherein ram pressure is generated without utilizing inertia of a mechanism, wherein, if a load is received from a work during a process of lowering the ram, motor speed is reduced according to the load, thereby reducing a lowering speed of the ram, and wherein the servo motor directly drives an operation shaft which vertically moves the ram.

7. The servo drive system according to claim 6, wherein the operation shaft comprises an eccentric shaft formed as a motor main shaft.

8. A servo drive system of a press machine, comprising:

a ram;

an operation shaft which vertically moves the ram; and a pair of servo motors which are opposed to each other at opposite ends of the operation shaft, and which operate as driving sources of the ram;

wherein the servo motors composite torques based in common on at least one speed-torque characteristic to generate ram pressure, wherein ram pressure is generated without utilizing inertia of a mechanism, wherein, if a load is received from a work during a process of lowering the ram, motor speed is reduced according to the load, thereby reducing a lowering speed of the ram, and wherein the pair of servo motors are integrally operated, thereby directly driving the operation shaft.

9. The servo drive system according to claim 8, wherein the operation shaft comprises an eccentric shaft formed as a motor main shaft.

10. A continuous working system of a press machine, comprising:

a ram;

an operation shaft which vertically moves the ram; and a servo motor which operates as a power source of the ram and which generates ram pressure using a torque based on speed-torque characteristics of a motor, wherein the operation shaft is directly driven using the servo motor, and wherein the operation shaft is continuously reciprocated and turned through an angle range corresponding to a distance between a predetermined lower end position required for press working by the ram and a position where the ram is returned from the lower end position and a lower end of the ram is separated from a tool upper surface such that the ram vertically moves between these positions by the servo motor, thereby subjecting a work to a continuous press working.

11. The continuous working system according to claim 10, wherein the servo motor uses a torque based on speed-torque characteristics of the motor, and wherein the servo motor generate ram pressure without utilizing inertia of a mechanism.

12. The continuous working system according to claim 10, wherein the operation shaft comprises an eccentric shaft formed as a motor main shaft.

13. A continuous working system of a press machine, comprising:

a ram;

an operation shaft which vertically moves the ram; and a pair of servo motors which operate as power sources of the ram, which are opposed to each other at opposite ends of the operation shaft, and which composite torques based in common on at least one speed-torque characteristic to generate ram pressure, wherein the operation shaft is directly driven using the pair of servo motors, and wherein the operation shaft is continuously reciprocated and turned through an angle range corresponding to a distance between a predetermined lower end position required for press working by the ram and a position where the ram is returned from the lower end position and a lower end of the ram is separated from a tool upper surface such that the ram vertically moves between these positions by the pair of servo motors, thereby subjecting a work to a continuous press working.

14. The continuous working system according to claim 13, wherein the servo motors use a torque based on speed-torque characteristics of the motor, and wherein the servo motors generate ram pressure without utilizing inertia of a mechanism.

15. The continuous working system according to claim 13, wherein the operation shaft comprises an eccentric shaft formed as a motor main shaft.

16. A servo drive system of a punch press, comprising:

a ram;

an operation shaft which vertically moves the ram; and a servo motor which operates as a power source of the ram and which generates ram pressure using a torque based on speed-torque characteristics of a motor, wherein the operation shaft is directly driven using the servo motor, and wherein the servo motor has a control power driver with a front stage at which is provided a reactor which suppresses peak current by cutting off high frequency current component, and a capacitor which supplies electric energy which becomes short due to suppression of the peak current.

17. The servo drive system of a punch press according to claim 16, wherein the capacitor supplies at least one of high speed operation electric energy and punching out electric energy which become short due to suppression of the peak current.

* * * * *